US007114792B2

(12) United States Patent
Kawauchi et al.

(10) Patent No.: US 7,114,792 B2
(45) Date of Patent: Oct. 3, 2006

(54) APPARATUS FOR CORRECTING INK DROPLETS PLACEMENT ERRORS FOR RECORDING APPARATUS, RECORDING APPARATUS HAVING APPARATUS FOR CORRECTING INK DROPLETS PLACEMENT ERRORS, AND METHOD FOR CORRECTING INK DROPLETS PLACEMENT ERRORS

(75) Inventors: Kenichi Kawauchi, Ebina (JP); Akira Mihara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 220 days.

(21) Appl. No.: 10/661,485

(22) Filed: Sep. 15, 2003

(65) Prior Publication Data

US 2004/0179055 A1 Sep. 16, 2004

(30) Foreign Application Priority Data

Mar. 10, 2003 (JP) ..... 2003-063570

(51) Int. Cl.
*B41J 29/393* (2006.01)
*B41J 29/38* (2006.01)

(52) U.S. Cl. ..... 347/19; 347/14

(58) Field of Classification Search ..... 347/9, 347/10, 12–14, 16, 19; 400/74
See application file for complete search history.

(56) References Cited

U.S. PATENT DOCUMENTS 5,805,183 A * 9/1998 Lidke et al. ..... 347/41
6,243,109 B1 * 6/2001 Ishinaga et al. ..... 347/3
6,655,771 B1 * 12/2003 Matsumoto et al. ..... 347/13

FOREIGN PATENT DOCUMENTS

JP 6-31923 * 1/1994 ..... 347/40
JP 9-1789 1/1997

* cited by examiner

*Primary Examiner*—Julian D. Huffman
(74) *Attorney, Agent, or Firm*—Morgan, Lewis & Bockius, LLP

(57) ABSTRACT

Ink droplets placement errors of a recording apparatus is to be corrected with high accuracy. Ink droplets placement errors in a subsidiary scanning direction of recording head units of a recording head array are obtained based on a result identified by reading a test chart for adjusting head alignment for detecting the errors, and it is then determined as to whether or not the errors identified is in a prescribed tolerance level (i.e., whether or not the printing result is good). In the case where it is judged that the printing result is not good, adjustment of alignment is carried out based on the errors identified. That is, the ink discharging timing of the recording head units is controlled per the period of the printing pulses, and the ink discharging timing of the recording head units is then controlled per the period of the controlling pulses.

19 Claims, 18 Drawing Sheets

APPARATUS FOR CORRECTING INK DROPLETS PLACEMENT ERRORS FOR RECORDING APPARATUS, RECORDING APPARATUS HAVING APPARATUS FOR CORRECTING INK DROPLETS PLACEMENT ERRORS, AND METHOD FOR CORRECTING INK DROPLETS PLACEMENT ERRORS

BACKGROUND OF THE INVENTION

1. Field of the Invention

The present invention relates to an apparatus for correcting ink droplets placement errors for a recording apparatus, a recording apparatus having an apparatus for correcting ink droplets placement errors, and a method for correcting ink droplets placement errors in a recording apparatus. More particularly, the invention relates to an apparatus for correcting ink droplets placement errors for a recording apparatus having a recording head part constituted by arranging plural recording heads in a first direction, the recording heads each being formed by arranging plural recording head units in a second direction perpendicular to the first direction, the recording head units each having plural ink discharging surface, and it also relates to the recording apparatus having an apparatus for correcting ink droplets placement errors, and a method for correcting ink droplets placement errors in the recording apparatus.

2. Description of the Related Art

As a conventional ink-jet recording apparatus, the following full multi recording head has been disclosed. The full multi recording head is constituted by mounting plural recording head units, each of which has plural orifices, on a substrate by sliding them into sliding grooves, as described in paragraphs 0017 to 0020 and FIG. 1 of JP-A-9-1789.

In the full multi recording head, however, because the recording head units are mounted by sliding them into sliding grooves, i.e., they are mounted by a mechanical system, there is a possibility of causing errors, and thus they cannot be mounted with high accuracy. Therefore, no high image quality can be expected for an image obtained by the conventional ink-jet recording apparatus.

SUMMARY OF THE INVENTION

The invention has been made in view of the aforementioned circumstances and provides such an apparatus for correcting ink droplets placement errors for a recording apparatus that is capable of correcting ink droplets placement errors of a recording apparatus with high accuracy, a recording apparatus having an apparatus for correcting ink droplets placement errors, and a method for correcting ink droplets placement errors.

The invention relates to, as a first aspect, an apparatus for correcting ink droplets placement errors for a recording apparatus containing a recording head part containing plural recording heads arranged in a first direction, the recording heads each containing plural recording head units arranged in a the second direction perpendicular to the first direction, the recording head units each having plural ink discharging surface, the apparatus for correcting ink droplets placement errors containing a controlling unit for controlling ink discharging timing of the plural recording head units in the recording head based on ink droplets placement errors on recording in the first direction of the plural recording head units in the recording head to reduce the ink droplets placement errors.

That is, the apparatus for correcting ink droplets placement errors according to the invention is that for a recording apparatus containing a recording head part containing plural recording heads arranged in the first direction, and the recording heads each contains plural recording head units, each of which has plural ink discharging surface, arranged in the second direction.

The controlling unit controls the ink discharging timing of the plural recording head units in the recording head based on the ink droplets placement errors on recording in the first direction of the plural recording head units in the recording head, in such a manner that the ink droplets placement errors are reduced.

In the invention, accordingly, the ink discharging timing of the plural recording head units in the recording head are controlled based on the ink droplets placement errors on recording in the first direction of the plural recording head units in the recording head, in such a manner that the ink droplets placement errors are reduced.

The apparatus also contains an identifying unit and an input unit. The identifying unit identifies the ink droplets placement errors by the recording head units in the first direction. The errors identified by the identifying unit may be obtained by providing the input unit for inputting the ink droplets placement errors, and inputting them with the input unit. That is, the controlling unit may control the ink discharging timing of the plural recording head units in the recording head based on the ink droplets placement errors thus input with the input unit, in such a manner that the ink droplets placement errors are reduced.

The invention also relates to, as a second aspect, an apparatus for correcting ink droplets placement errors for a recording apparatus containing a recording head part containing plural recording head arrays in a first direction, the recording head arrays each containing plural recording head units arranged in a second direction perpendicular to the first direction, the recording head units each having plural ink discharging surface, the apparatus for correcting ink droplets placement errors containing a controlling unit for controlling ink discharging timing of the plural recording head units in the recording head based on a ink droplets placement errors on recording in the first direction of the plural recording head arrays to reduce the ink droplets placement errors.

The apparatus for correcting ink droplets placement errors according to this aspect of the invention is that for a recording apparatus containing a recording head part containing plural recording head arrays arranged in the first direction, and the recording head arrays each contains plural recording head units, each of which has plural ink discharging surface, arranged in the second direction.

The controlling unit controls the ink discharging timing of the plural recording head units in the recording head based on the ink droplets placement errors on recording in the first direction of the plural recording head arrays, in such a manner that the ink droplets placement errors are reduced.

The apparatus also contains an identifying unit and an input unit. The identifying unit identifies the ink droplets placement errors by the recording head arrays in the first direction. The errors identified by the identifying unit may be obtained by providing the input unit for inputting the ink droplets placement errors, and inputting them with the input unit.

The invention also relates to, as a third aspect, an apparatus for correcting ink droplets placement errors for a recording apparatus containing a recording head part containing plural recording heads arranged as corresponding to plural colors, the recording heads each containing plural recording head arrays arranged in a first direction, the recording head arrays each containing plural recording head units arranged in a second direction perpendicular to the first direction, the recording head units are disposed in a staggered arrangement, and each having plural ink discharging surface, the apparatus for correcting ink droplets placement errors containing a controlling unit for controlling ink discharging timing of the plural recording head units in the recording heads based on ink droplets placement errors on recording in the first direction of the plural recording heads to reduce the ink droplets placement errors.

The apparatus for correcting ink droplets placement errors according to this aspect of the invention is that for a recording apparatus containing a recording head part containing plural recording heads arranged as corresponding to plural colors, the recording heads each containing plural recording head arrays arranged in a first direction, the recording head arrays each containing plural recording head units arranged in a second direction perpendicular to the first direction, the recording head units are disposed in a staggered arrangement, and each having plural ink discharging surface.

The controlling unit controls ink discharging timing of the plural recording head units in the recording heads based on the ink droplets placement errors on recording in the first direction, in such a manner that the ink droplets placement errors are reduced.

The apparatus also contains an identifying unit and an input unit. The identifying unit identifies the ink droplets placement errors by the recording heads in the first direction. The errors identified by the identifying unit may be obtained by providing the input unit for inputting the ink droplets placement errors, and inputting them with the input unit. That is, the controlling unit may control the ink discharging timing of the plural recording head units in the recording heads based on the ink droplets placement errors thus input with the input unit, in such a manner that the ink droplets placement errors are reduced.

The invention also relates to, as a fourth aspect, an apparatus for correcting ink droplets placement errors for a recording apparatus containing a recording head part containing plural recording heads arranged as corresponding to plural colors, the recording heads each containing plural recording head arrays arranged in a first direction, the recording head arrays each containing plural recording head units arranged in a second direction perpendicular to the first direction, the recording head units are disposed in a staggered arrangement, and each having plural ink discharging surface, the apparatus for correcting ink droplets placement errors containing a controlling unit for controlling ink discharging timing of the plural recording head units in the recording heads based on a first ink droplets placement error on recording in the first direction of the plural recording head units in the recording heads, a second ink droplets placement error on recording in the first direction of the plural recording head arrays, and a third ink droplets placement error on recording in the first direction of the plural recording heads to reduce the ink droplets placement errors.

The apparatus for correcting ink droplets placement errors according to this aspect of the invention is that for a recording apparatus containing a recording head part containing plural recording heads arranged as corresponding to plural colors, the recording heads each containing plural recording head arrays arranged in a first direction, the recording head arrays each containing plural recording head units arranged in a second direction perpendicular to the first direction, the recording head units are disposed in a staggered arrangement, and each having plural ink discharging surface.

The controlling unit controls ink discharging timing of the plural recording head units in the recording heads based on the first ink droplets placement error on recording in the first direction of the plural recording head units in the recording heads, the second ink droplets placement error on recording in the first direction of the plural recording head arrays, and the third ink droplets placement error on recording in the first direction of the plural recording heads, in such a manner that the ink droplets placement errors are reduced.

The apparatus also contains an identifying unit and an input unit. The identifying unit identifies the ink droplets placement errors by the recording head units and the recording head arrays and the recording heads in the first direction. The first ink droplets placement errors identified by the identifying unit of the plural recording head units in the recording heads, the second ink droplets placement errors identified by the identifying unit of the plural recording head arrays, and the third ink droplets placement errors identified by the identifying unit of the plural recording heads, may be obtained by providing the input unit for inputting the ink droplets placement errors, and inputting them with the input unit. That is, the controlling unit may control the ink discharging timing of the plural recording head units in the recording heads based on the ink droplets placement errors thus input with the input unit, in such a manner that the first to third ink droplets placement errors are reduced.

The invention also relates to, as a fifth aspect, a recording apparatus containing an apparatus for correcting ink droplets placement errors for a recording apparatus according to one of the first to fourth aspects of the invention.

The invention also relates to, as a sixth aspect, a method for correcting ink droplets placement errors for a recording apparatus containing a recording head part containing plural recording heads arranged as corresponding to plural colors, the recording heads each containing plural recording head arrays arranged in a first direction, the recording head arrays each containing plural recording head units arranged in a second direction perpendicular to the first direction, the recording head units are disposed in a staggered arrangement, and each having plural ink discharging surface, the method containing steps of: recording an image for adjusting ink discharging timing on a recording medium with the recording head part; reading the image for adjusting ink discharging timing; detecting at least one of a first ink droplets placement error on recording in the first direction of the plural recording head units in the recording heads, a second ink droplets placement errors on recording in the first direction of the plural recording head arrays, and a third ink droplets placement error on recording in the first direction of the plural recording heads, based on a result obtained by reading the image for adjusting ink discharging timing; and controlling ink discharging timing of the plural recording head units in the recording heads based on the ink droplets placement errors thus detected, to reduce the ink droplets placement errors.

In the invention as described in the foregoing, the ink droplets placement errors on recording are reduced by controlling the ink discharging timing of the recording head units, and accordingly, ink droplets placement errors of a recording apparatus can be corrected with high accuracy.

DESCRIPTION OF THE PREFERRED EMBODIMENTS

An embodiment of the invention will be described in detail with reference to the drawings.

An ink-jet recording apparatus, to which a recording apparatus according to the embodiment is applied, will be described.

Overall Constitution of Ink-Jet Recording Apparatus

The overall constitution of the ink-jet recording apparatus will be briefly described.

Figure 1:
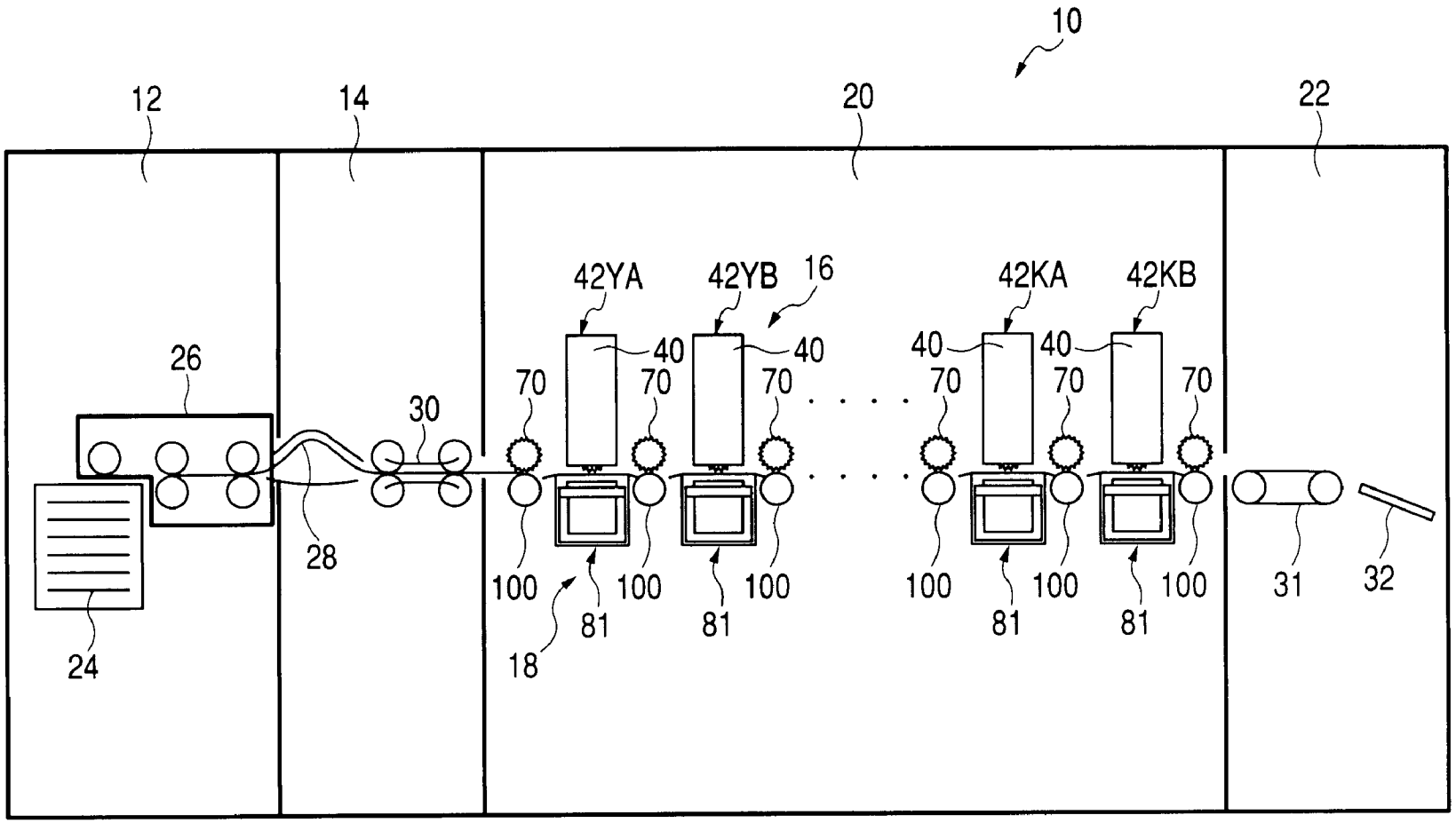
FIG. 1 is a schematic constitutional view showing a recording apparatus according to an embodiment of the invention.

As shown in FIG. 1, the ink-jet recording apparatus 10 is basically constituted with a paper feeding part 12 for conveying a paper, a registration adjustment part 14 for controlling the orientation of the paper, a recording part 20 having a recording head part 16 for forming an image on the paper by discharging ink droplets and a maintenance part 18 for carrying out maintenance of the recording head part 16, and a paper delivery part 22 for delivering the paper having an image formed thereon in the recording part 20.

The paper feeding part 12 is constituted with a stocker 24 having accumulated sheets of paper stocked therein, and a conveying apparatus 26 for conveying a sheet of paper one by one from the stocker 24 to the registration adjustment part 14.

The registration adjustment part 14 has a loop forming part 28 and a guide member 30 for controlling the orientation of the paper, and upon passing the paper through the registration part 14, skew of the paper is corrected with stiffness of the paper, and the conveying timing is controlled and the paper is conveyed to the recording part 20.

The recording part 20 has a paper conveying path, in which the paper is conveyed between the recording head part 16 and the maintenance part 18, and an image is formed on the paper, which is continuously (without stoppage) conveyed on the paper conveying path, by discharging ink droplets from the recording head part 16. Pairs of the recording head part 16 and the maintenance part 18 are unitized, respectively, and the recording head part 16 is construed as being removably from the maintenance part 18 disposed opposite thereto with the paper conveying path intervening therebetween. Therefore, in the case of paper jam, jammed paper can be easily removed. The recording part 20 will be described in detail later, and descriptions thereof are omitted herein.

The paper delivery part 22 houses the paper having an image formed in the recording part 20 in a tray 32 through a paper delivery belt 31.

Constitution of Recording Head Part

Figure 2:
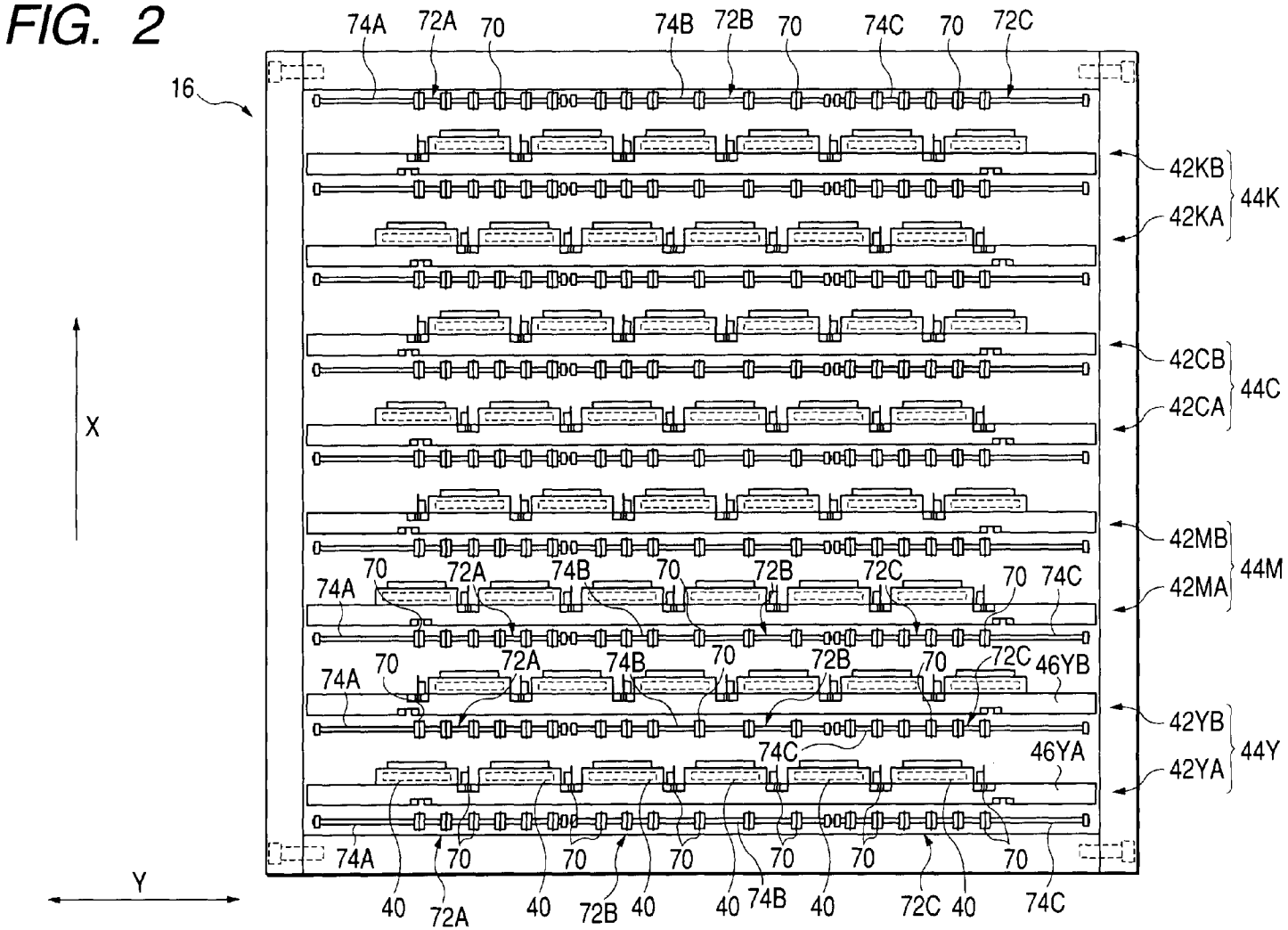
FIG. 2 is a schematic plane view showing a recording head part according to an embodiment of the invention.

The recording head part 16 will be described in detail with reference to FIGS. 2 to 7. FIG. 2 is a schematic plane view showing the recording head part 16 viewed from above. (The plane view from above is employed for the sake of convenience upon parallelizing with FIG. 8.)

As shown in FIG. 2, the recording head part 16 basically has eight recording head arrays 42 arranged in a first direction which the paper is conveyed (the direction shown by the arrow X in the figure, which is hereinafter sometimes referred to as a first direction) at a constant interval, and each of the recording head arrays 42 has six recording head units 40 arranged in a second direction perpendicular to the first direction (the direction shown by the arrow Y in the figure, which is hereinafter sometimes referred to as a second direction) at a constant interval.

Figure 3:
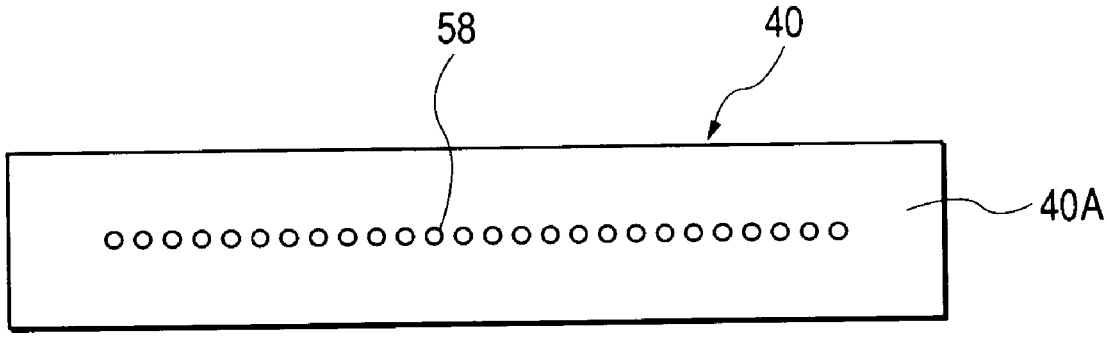
FIG. 3 is a plane view showing a recording head unit according to an embodiment of the invention.

As shown in FIG. 3, the recording head unit 40 has nozzles 58 for discharging an ink arranged in a straight form on the nozzle surface 40A, ink droplets are discharged there from by a known thermal ink-jet system. In this embodiment, the recording head unit 40 has 800 nozzles with a nozzle arrangement density of 800 dpi and a discharging frequency of 7.56 kHz and uses a pigment ink.

Six recording head units 40 are attached to a common substrate 46, which will be described later, in a straight form in such a manner that the arranging direction of the recording head units 40 agree with the second direction, so as to form the recording head arrays 42A and 42B.

Figure 4:
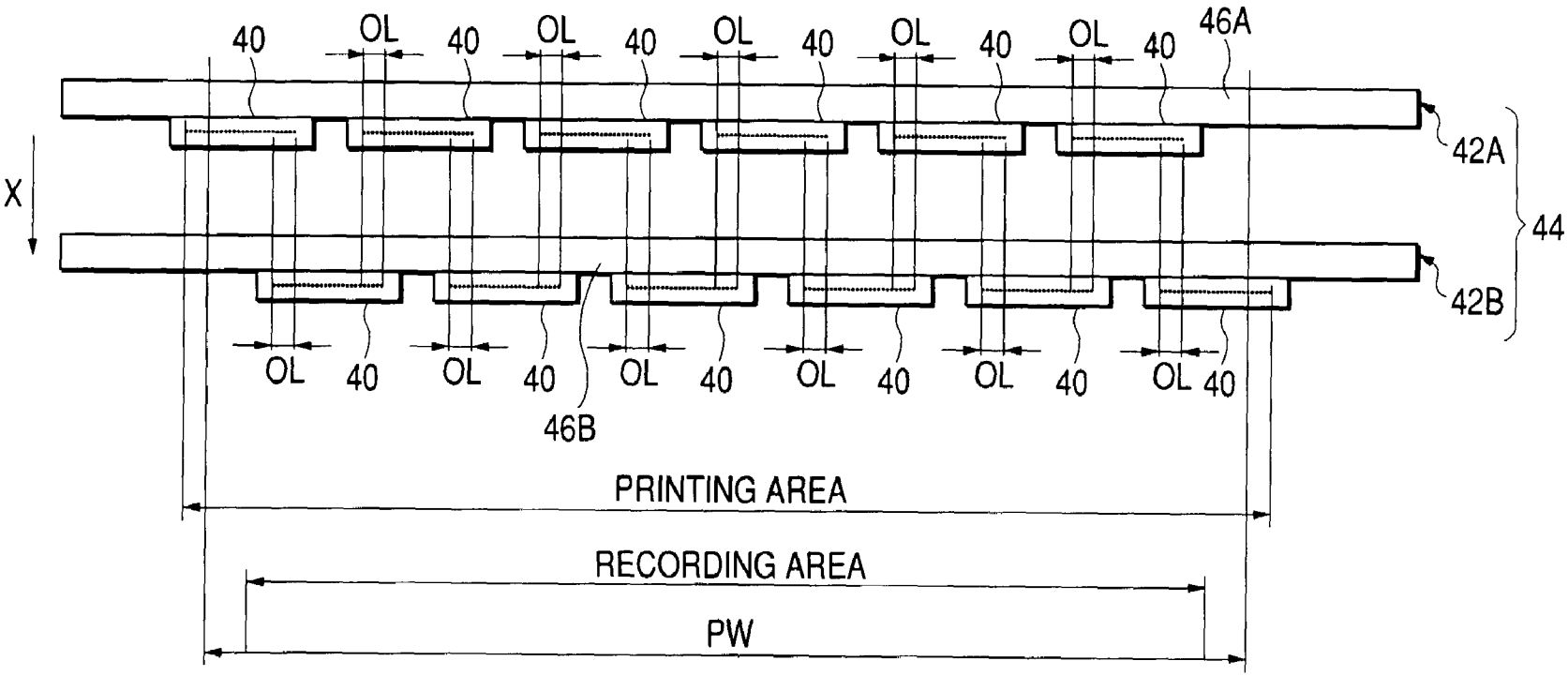
FIG. 4 is a constitutional explanatory view showing a recording head array according to an embodiment of the invention.

As shown in FIG. 4, the recording head arrays 42A and 42B each has six recording head units 40 arranged at a constant interval, and the arrangement of the recording head units 40 is deviated between the recording head arrays 42A and 42B, whereby the rows of nozzles of the recording head units 40 partly overlap each other between the recording head arrays 42A and 42B. The overlapping areas OL thus provided prevent formation of a non-printing area in the printing area. The nozzles 58 of the recording head units 40 of the pair of recording head arrays 42A and 42B eject ink droplets to print an image of one color on the paper. In this embodiment, a combination of the pair of recording head arrays 42A and 42B is referred to as a recording head 44.

The recording head 44 of this embodiment has a printing area of 12 inches, which is wider than 297 mm, the shorter width of A3 size paper (i.e., the longer width of A4 size paper), as the maximum paper width PW.

The recording heads 44 are arranged to print images of yellow (Y), magenta (M), cyan (C) and black (K) from the upstream of the first direction to attain full color printing, and symbols, Y, M, C and K, are attached to the reference numbers of the corresponding recording head (i.e., 44Y, 44M, 44C and 44K) depending on necessity to distinguish the recording heads, as shown in FIG. 2. The nomenclature is also applied to the other members.

In FIG. 2, because the recording heads 44Y, 44M, 44C and 44K have the same constitution, only constitutional elements of the recording head 44Y are attached with reference symbols, and reference symbols for constitutional elements of the other recording heads 44M, 44C and 44K are omitted.

Figure 5:
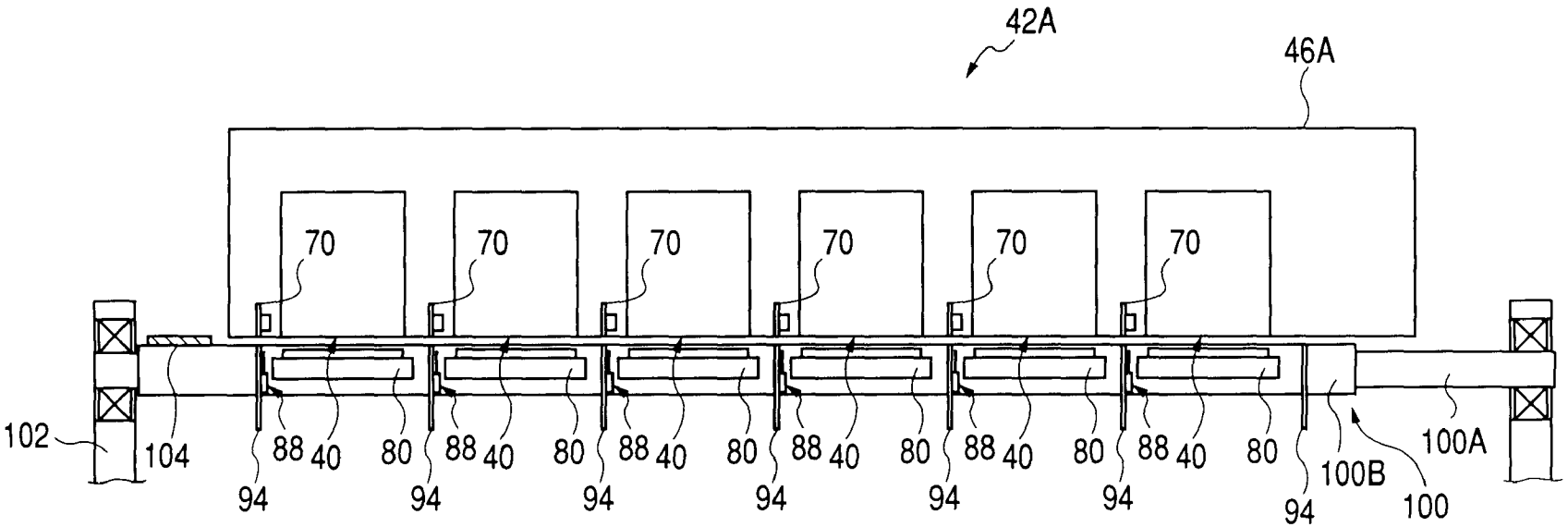
FIG. 5 is a vertical cross sectional view showing a recording part according to an embodiment of the invention.

As shown in FIG. 5, the recording head array 42A constituting the recording head 44 has six recording head units 40 attached at a prescribed interval to the common substrate 46A extending in the second direction.

In other words, the recording head units 40 are attached to the common substrate 46A, whereby the rows of nozzles are arranged in the second direction as shown in FIG. 4.

Figure 6:
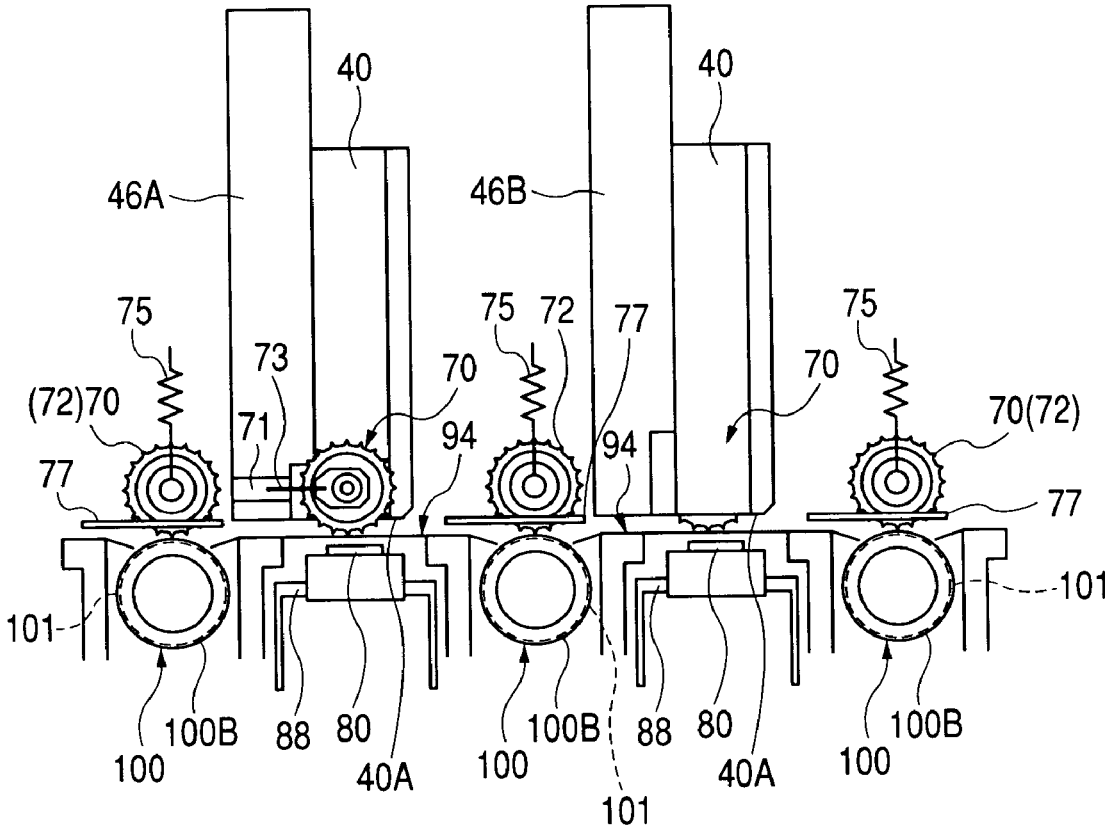
FIG. 6 is a side view of an important part of a recording part according to an embodiment of the invention.

In the recording head part 16, groups of three star wheels 72A to 72C are arranged among the recording head arrays 42, on the upstream of the most upstream recording head array 42YA, and on the downstream of the most downstream recording head array 42KB, as shown in FIG. 2. The groups of star wheels 72A to 72C each has six star wheels 70 pivotally supported with a prescribed interval by three shafts 74A to 74C, which are continuously arranged in the second direction. The shafts 74A to 74C are energized on both ends thereof with a spring 75 to a conveying roll 100 described later. The ink droplets placement errors to the side of the conveying roll 100 of the star wheel 70 is restricted with a restriction member 77 to such an extent that the star wheel 70 is stopped at a position slightly breaking into the surface of the conveying roll 100 as shown in FIG. 6.

The intervals of the star wheels 70 in the second direction are determined at 25.4 mm at most. This is because it is preferably 50 mm or less in order to floatage and deformation locally occurring in the paper.

The force for pressing the star wheel 70 onto the conveying roll 100 with the spring 75 is 10 gf per one wheel. In the case where the pressing force is less than 5 gf, the paper cannot be sufficiently held on the conveying roll 100, and in the case where it exceeds 30 gf, the star wheel 70 damages the paper.

Figure 7A:
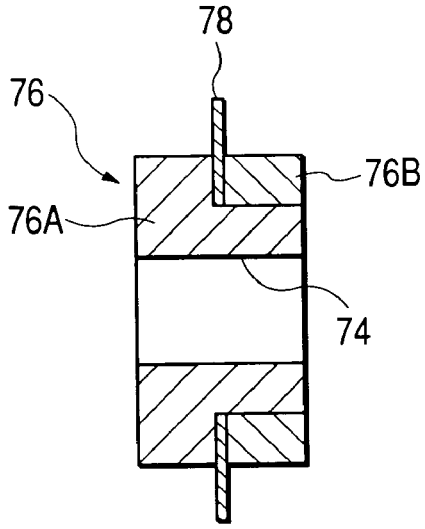
FIG. 7A is a cross sectional view showing a star wheel.

As shown in FIG. 7A, the star wheel 70 is constituted with a retaining member 76 formed with a resin having a cylindrical shape with a hole 74 formed therein, and a wheel 78 formed with stainless steel retained by the retaining member 76.

Figure 7B:
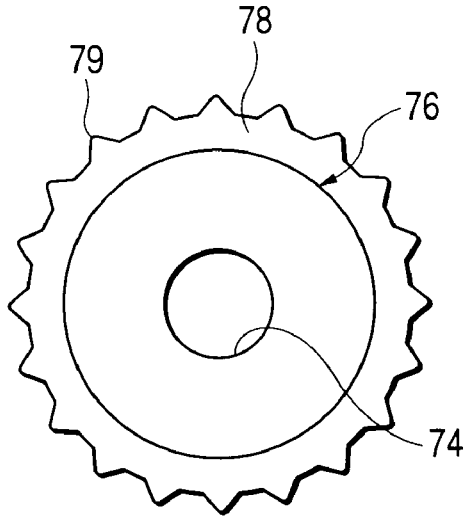
FIG. 7B is a side view thereof.
Figure 7C:
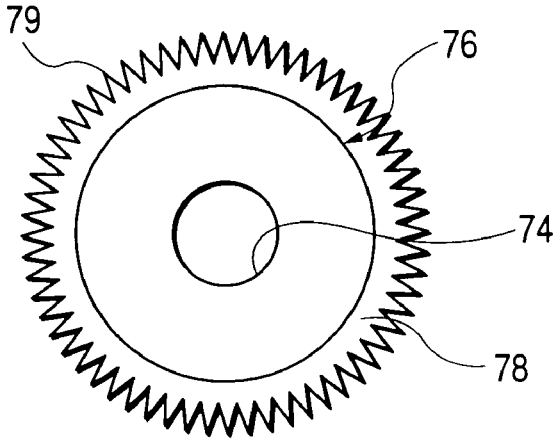
FIG. 7C is a side view of another example thereof.

The retaining member 76 is constituted with a first member 76A having a diameter reduced at a center in an axial direction to enable insertion of the wheel, and a second member 76B engaged in the part of the first member 76A having the reduced diameter to hold the wheel 78 associated with the first member 76A. The wheel 78 has a large number of teeth 79 on the outer periphery at a constant interval. The tooth 79 has an obtuse tip angle with a round tip end as shown in FIG. 7B, but such a shape is sufficient that has a reduced contact area as small as possible since it is in contact with an undried ink on the paper, and it may have, for example, an acute tip angle as shown in FIG. 7C.

The thickness of the wheel 78 in this embodiment is 0.1 mm, which is thinned by tapering to about from 0.01 to 0.02 mm at the tip end (tooth top) thereof. The wheel 78 is produced with a stainless steel material, SUS631EH, through stepwise etching on both surfaces to process the tip end shape and the taper shape simultaneously, and has a fluorine resin water-repellent coating on the surface.

The recording head array 42A also has star wheels 70 adjacent in the second direction to the respective recording head units 40. The star wheel 70 is pivotally supported elastically at a tip end of a supporting member 71, which is engaged with the common substrate 46A through a blade spring 73, as shown in FIG. 6.

Constitution of Maintenance Part

Figure 8:
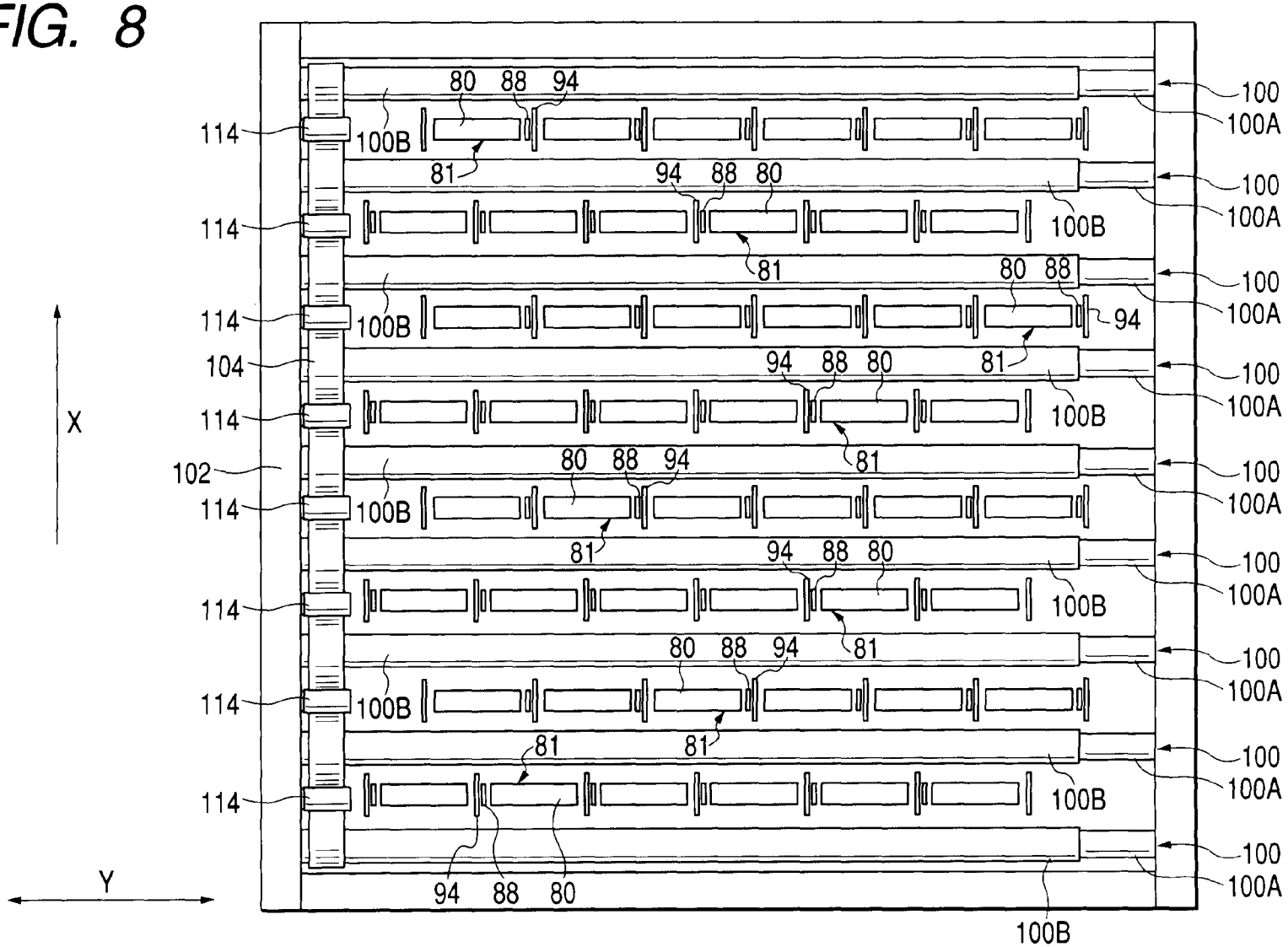
FIG. 8 is a schematic plane view showing a maintenance part according to an embodiment of the invention.

The constitution of the maintenance part 18 disposed opposite to the recording part 20 will be described with reference to FIGS. 8 to 13. FIG. 8 is a schematic plane view showing the maintenance part 18 viewed from the conveying position.

The maintenance part 18 is disposed opposite to the recording part 20 with the paper conveying position intervening therebetween, and as shown in FIG. 8, it has maintenance apparatus 81 arranged at positions opposite to the respective recording head units 40 of the recording part 20. The maintenance apparatus 81 is constituted with a cap member 80 and a wiping member 88.

Figure 9:
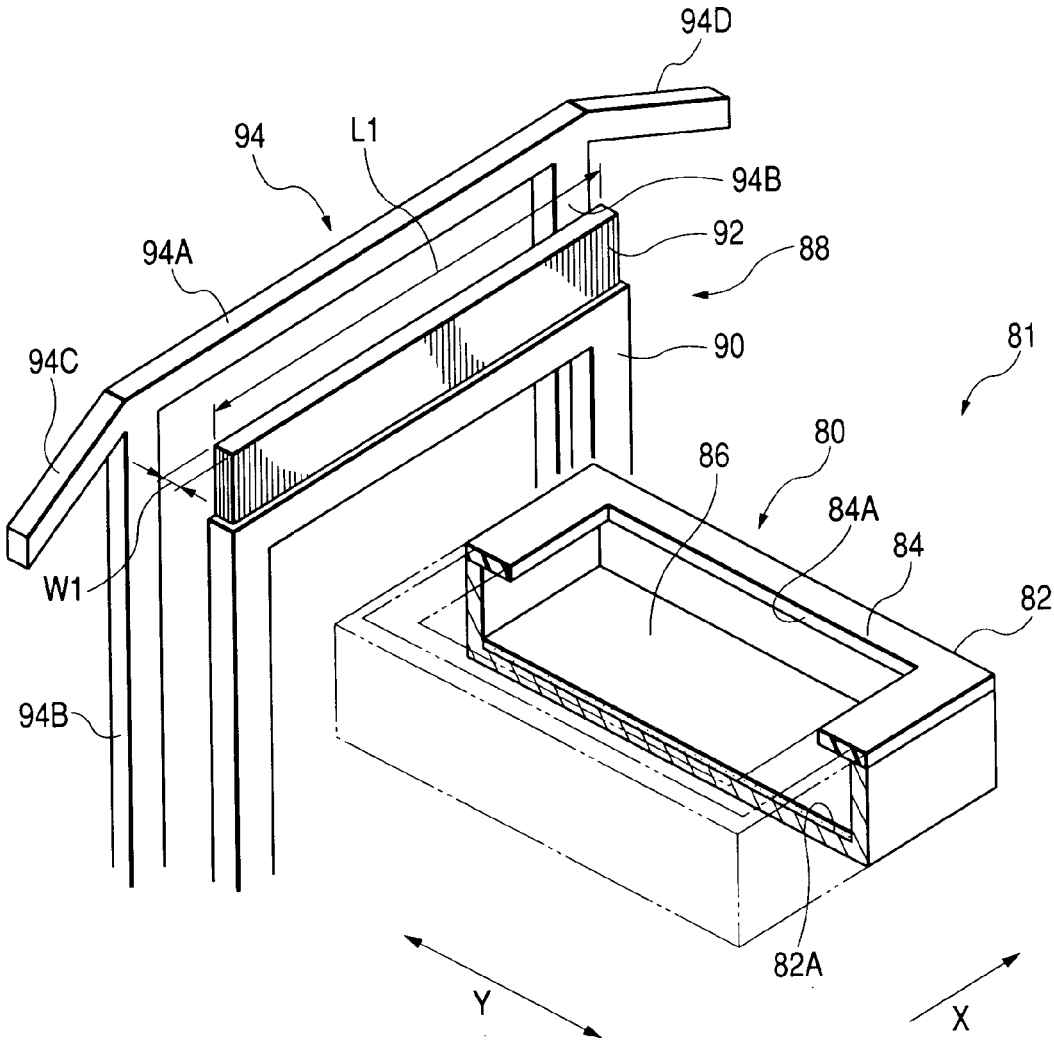
FIG. 9 is a perspective view showing an important part of a maintenance part according to an embodiment of the invention.

As shown in FIG. 9, the cap member 80 is constituted with a receiving member 82 formed with a PBT resin having a concave part 82A of a rectangular shape with a depth of 8 mm, a rubber member 84 formed with silicone rubber (having a hardness of 40 Hs) on an upper part of the receiving member 82, and an ink absorbent 86 formed with polypropylene and polyethylene disposed over the bottom of the concave part 82A. Therefore, upon carrying out dummy jet described later, ink droplets are ejected from the nozzles 58 of the respective recording head units 40 to the interior of the concave part 82A through an opening 84A of the cap member 80, and are absorbed with the ink absorbent 86.

Figure 10:
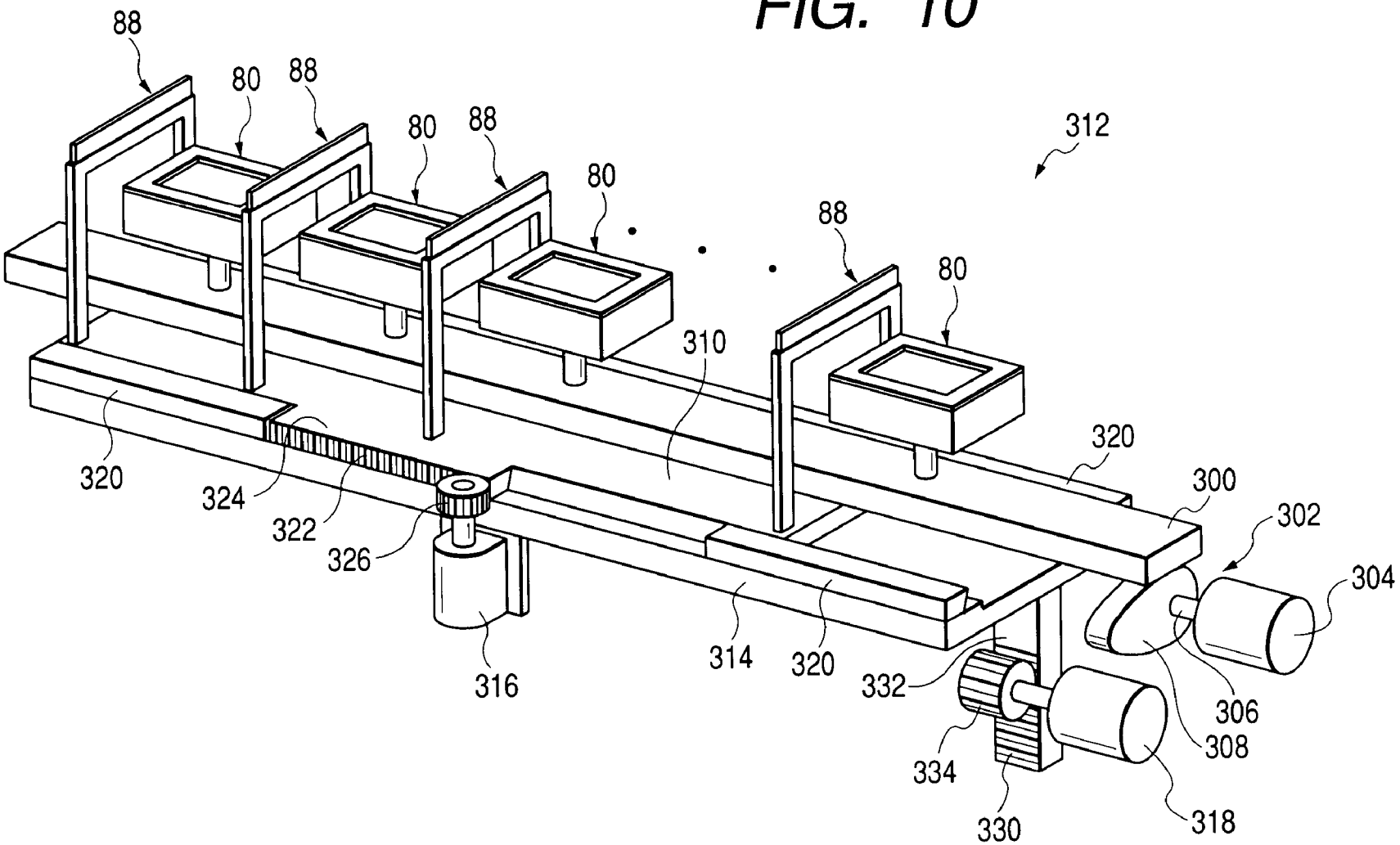
FIG. 10 is a perspective view showing an elevating mechanism and a moving mechanism of a maintenance part according to an embodiment of the invention.

As shown in FIG. 10, six cap members 80 corresponding to the recording head units 40 constituting the recording head array 42 are attached to a common substrate 300 and unitized, and they are constituted as they can integrally approaching to and leaving from the nozzle surface 40A of the recording head unit 40 with an elevating mechanism 302.

The elevating mechanism 302 is constituted with a driving motor 304 and an eccentric cam 308 attached to a driving axis 306 of the driving motor 304 and in contact with a lower surface of the common substrate 300. Accordingly, the eccentric cam 308 is rotated upon driving the driving motor 304, and thus the common substrate 300 in contact with the eccentric cam 308 approaches to and leaves from the nozzle surface 40A of the recording head unit 40.

The cap member 80 has, on the lower surface thereof, a spring 87 for adjusting the pressing force upon contacting with the nozzle surface 40A as shown in FIG. 14. Accordingly, upon capping operation described later, the cap member 80 rises, and the rubber member 84 is pressed onto the nozzle surface 40A to seal the nozzle surface 40A including the nozzles 58, whereby drying of the ink is suppressed, and attachment of dusts is prevented. Furthermore, upon wiping operation described later, the cap member 80 descends, whereby the wiping member 88 is made movable in the second direction.

The wiping member 88 for cleaning the nozzle surface 40A of the recording head unit 40 is disposed at a position adjacent in the second direction to the cap member 80 as shown in FIGS. 9 and 10.

As shown in FIG. 9, the wiping member 88 is constituted with a retaining member 90 having a substantially gantry shape as viewed from the second direction, and a wiper 92 disposed on an upper part of the retaining member 90 and extending in the first direction.

The wiper 92 is formed with a thermoplastic polymer resin (having a hardness of 65 Hs) and has a length in the first direction L1 of 8 mm, a thickness in the second direction W1 of 0.8 mm and a height from the retaining member 90 (free length) of 6 mm.

The retaining member 90 is formed with a stainless steel (SUS) material.

The wiping member 88 is disposed at a position at 1 mm from the end of the cap member 80 in the second direction.

As shown in FIG. 10, all the wiping members 88 corresponding to the respective recording head units 40 constituting the recording head array 42 are attached to a common substrate 310 and unitized, and they can integrally approaching to and leaving from the nozzle surface 40A of the recording head unit 40 and are movable in the second direction with a moving mechanism 312.

The moving mechanism 312 is basically constituted with a slider 314 supporting the common substrate 310 movably in the second direction, a driving motor 316 for moving the common substrate 310 on the slider 314 in the second direction, and a driving motor 318 for elevating the slider 314. The slider 314 has guides 320, which are provided on both ends in the first direction and extend in the second direction, and the common substrate 310 guided with the guides 320 is movable in the second direction. Protrusions 324 constituting a rack 322 are formed on one side surface of the common substrate 310, with which a driving gear 326 of the driving motor 316 attached to the slider 314 is engaged. Accordingly, the common substrate 310 is movable on the slider 314 in the second direction by driving the driving motor 316.

Protrusions 332 constituting a rack 330 extending in a vertical direction are provided on a lower surface of the slider 314, with which a driving gear 334 of the driving motor 318 is engaged. Accordingly, the slider 314 can be elevated by driving the driving motor 318. That is, the common substrate 310 and wiping members 88 supported by the slider 314 are integrally elevated.

Figure 11A:
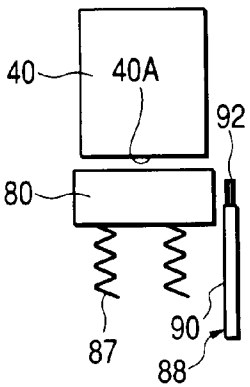
FIGS. 11A to 11G are operational explanatory views showing wiping operation in a recording apparatus according to an embodiment of the invention.
Figure 11B:
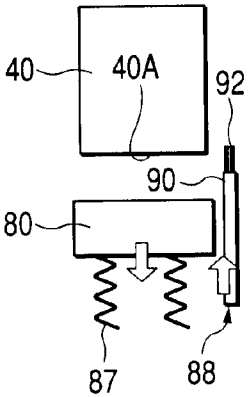
Figure 11C:
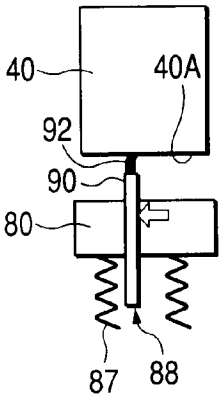

According to the constitution, the wiping members 88 can approach to and leave from the nozzle surface 40A (i.e., can be elevated) and are movable in the second direction with the moving mechanism 312. That is, the wiping member 88 (wiper 92) in the home position is disposed at a position lower than the cap member 80 to prevent from interfering the paper thus conveyed (as shown in FIG. 11A), and upon wiping, it rises and moves in the first direction by overstriding the cap member 80 thus descending from the home position to effect wiping (as shown in FIG. 11C).

In order to prevent the paper penetrating into the concave part 82A of the cap member 80 upon conveying the paper in the recording part 20, guide members 94 are provided on both sides of the cap member 80 in the second direction as shown in FIG. 9. The guide member 94 is formed with a stainless steel material and constituted with a horizontal part 94A extending in the first direction, two vertical parts 94B extending from both ends of the horizontal part 94A in a vertical downward direction, and guide parts 94C and 94D extending from both ends in the first direction of the horizontal part 94A in a obliquely downward direction toward the first direction.

The horizontal part 94A of the guide member 94 is disposed opposite to the star wheel 70 disposed between the recording head units as shown in FIGS. 2, 8 and 6). Accordingly, the paper thus conveyed is in contact with the guide member 94 (horizontal part 94A) by the star wheel 70 at the printing position in the first direction, whereby the distance between the nozzle surface 40A and the paper deformed by attachment of an ink or the like is maintained constant as shown in FIG. 6.

Subsequently, the home position of the respective members constituting the maintenance apparatus 81 in this embodiment (i.e., the position where no maintenance is carried out on the recording head unit 40 during image printing) will be described.

The cap member 80 is disposed under the nozzle surface 40A of the recording head unit 40, whereby the rubber member 84 covers, in plane view, the entire nozzle surface 40A of the recording head unit 40, and all the nozzles 58 of the recording head units 40 are positioned, in plane view, within the opening 84A of the rubber member 84.

The wiping member 88 is disposed in such a manner that the tip end of the wiper 92 is positioned under the nozzle surface of 40A of the recording head unit 40, and disposed at such a position in that a longitudinal direction (in the first direction) of the wiper 92 covers, in plane view, the entire width in the first direction of the nozzle surface 40A of the recording head unit 40, and the wiper 92 is placed at a position apart from the end in the second direction of the recording head unit 40 by 1 mm (i.e., such a position in that the wiper can clean the recording head in the shorter second direction thereof).

The guide member 94 is disposed in such a manner that the uppermost surface of the horizontal part 94A, which is in contact with the paper, is positioned under the nozzle surface 40A of the recording head unit 40, and disposed at such a position in that the longitudinal direction in the first direction of the horizontal part 94A of the guide member 94 covers, in plane view, the nozzle surface 40A of the recording head unit 40, and the uppermost surface of the horizontal part 94A, which is in contact with the paper, is placed at a position apart from the end in the second direction of the recording head unit 40 by 2 mm.

Subsequently, a mechanism for conveying the paper between the maintenance apparatus 81 and the recording head unit 40 will be described.

Conveying rolls 100 for conveying the paper by transmitting a driving force thereto are disposed at both ends in the first direction and between the cap members 80 adjacent to each other in the first direction in the maintenance part 18 as shown in FIG. 8. The conveying rolls 100 are disposed as corresponding to the disposed positions of the groups of star wheels 72A to 72C as shown in FIG. 6, and the paper is made in contact with the conveying rolls 100 with the star wheels 70 of the groups of star wheels 72A to 72C, which are elastically pressed onto the side of the conveying rolls 100 with the springs 75, so as to transmit the driving force from the conveying rolls 100 to the paper.

The conveying roll 100 is constituted with a small diameter part 100A supported pivotally with a casing 102, and a large diameter part 100B, which has a larger diameter than the small diameter part 100A and is in contact with the star wheel 70, as shown in FIG. 5. The conveying roll 100 transmits the driving force to the paper through the large diameter part 100B, and is preferably those that have a large friction coefficient and are difficultly worn. The conveying roll 100 in this embodiment is constituted with a metallic roll (SUS303) with a diameter of 10 mm having ceramic fine powder mainly containing alumina spray-coated thereon, followed by sintering, and satisfies the aforementioned requirements. The spray-coating is applied not only to the printing area of the large diameter part 100B of the conveying roll 100, which is in contact with the paper, but also to the non-printing area thereof, which is in contact with a flat belt 104.

In order to prevent the tooth tops of the star wheel 70 from being deformed by contacting with the surface of the conveying roll 100, a groove 101 having a width of 2 mm and a depth of 2 mm is provided at a part of the conveying roll 100 opposite to the star wheel 70 as shown in FIG. 6. Furthermore, in order to prevent the paper conveying resistance from being increased upon increasing the penetrating amount of the star wheel 70 into the groove 101, a restriction member 77 for restricting the penetrating amount of the star wheel 70 is provided as shown in FIG. 6.

Figure 12:
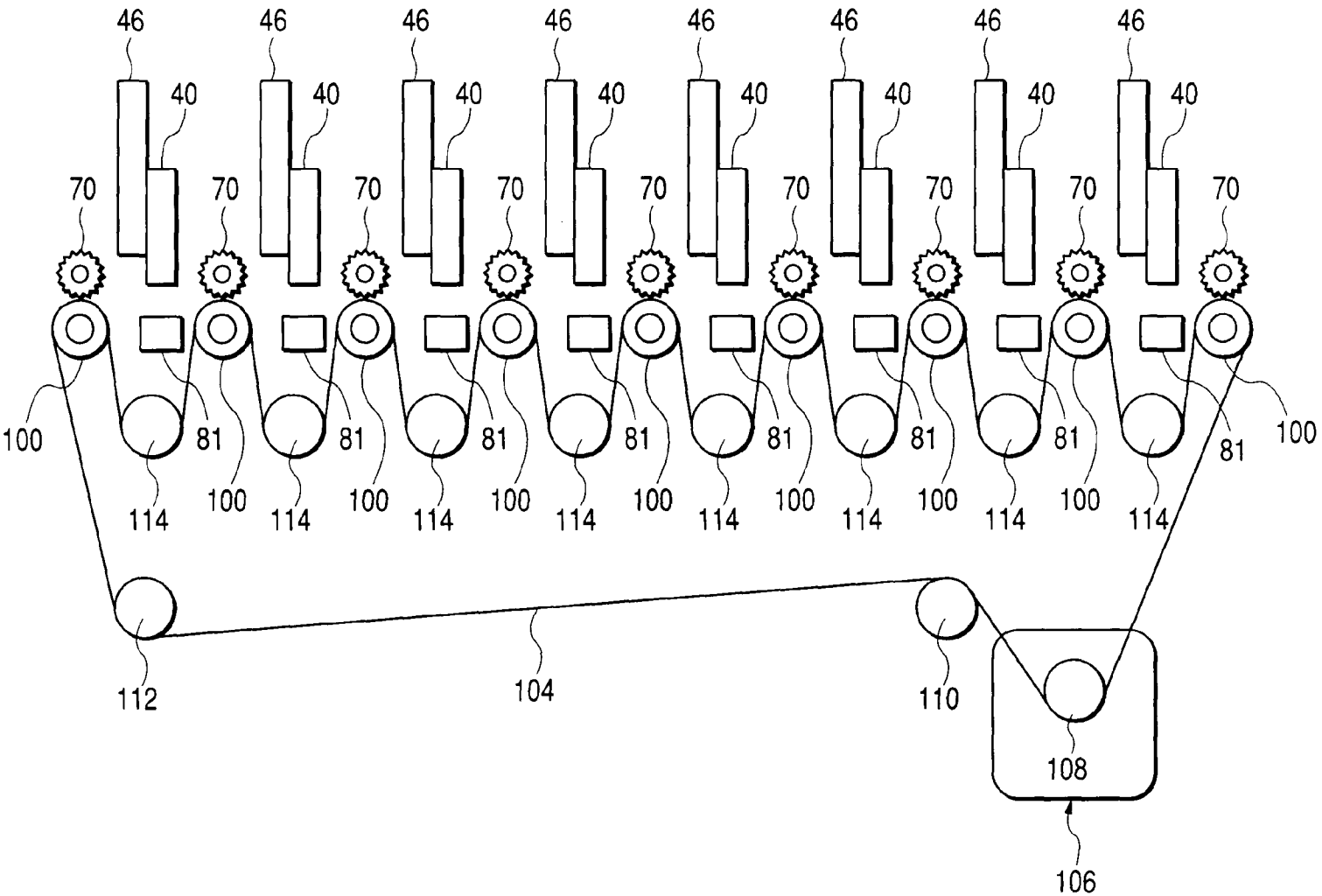
FIG. 12 is an explanatory view showing a driving mechanism of a recording apparatus according to an embodiment of the invention.

As shown in FIG. 12, the driving mechanism for driving the conveying rolls 100 is constituted in such a manner that a flat belt 104 is stretched and wound on a driving shaft 108 of a single motor 106 to all the conveying rolls 100 through idler rolls 110 and 112. Idler rolls 114 are disposed between the conveying rolls 100 adjacent to each other to ensure a wound angle of the flat belt on the respective conveying rolls 100 (large diameter parts 100B).

Figure 13:
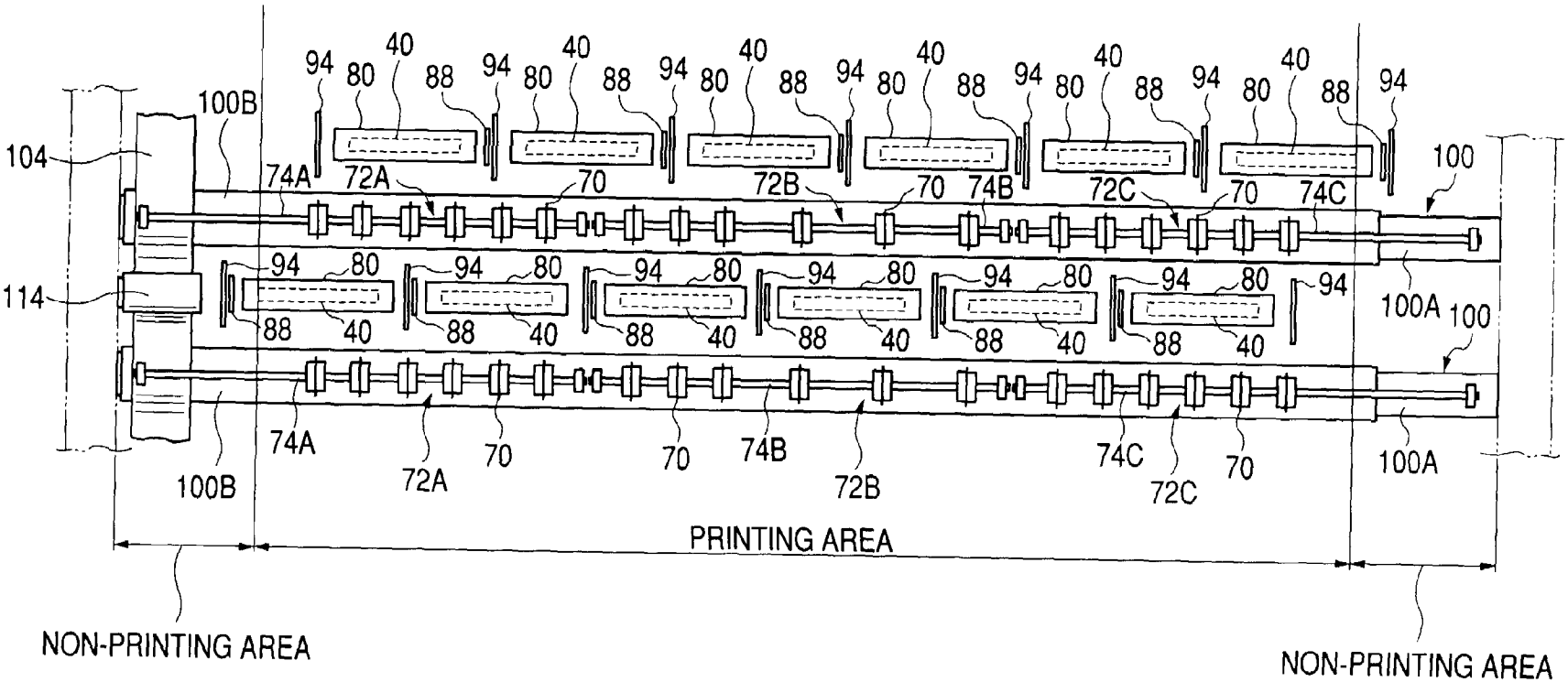
FIG. 13 is a plane view showing an important part of a paper conveying mechanism according to an embodiment of the invention.

As shown in FIG. 13, the flat belt 104 is wound on the non-printing area outside the printing area in the large diameter part 100B of the conveying roll 100, with which the paper is in contact.

The single motor 106 is employed because of the following reason. In the case where plural motors are employed, the driving velocity and the fluctuation characteristics thereof of the respective motors are difficult to be made uniform, and as a result, the fluctuation components in velocity are accumulated on the paper velocity, whereby the velocity fluctuation of the paper causes problems by accumulation of the velocity fluctuation of the motors even though the velocity fluctuation of the respective motors is sufficiently low. That is, the plural conveying rolls 100 are driven by the single driving source (i.e., the motor 106), whereby the conveying velocity of the paper is made uniform to attain printing with high quality.

The flat belt 104 transmits the driving force to the conveying rolls 100 without engagement of teeth (with a frictional force), and therefore, it is particularly preferred since no periodical velocity fluctuation by every teeth occurs.

The flat belt 104 in this embodiment has a thickness of 0.4 mm and is constituted with a base material formed by weaving polyester fibers having a thin film coating of polyurethane formed on one surface thereof, so as to attain both high mechanical strength and high friction.

According to the recording part 20 thus constituted in first embodiment, the distance between the nozzle surface and the paper is designed to be 1.5 mm, and the paper is horizontally conveyed between them. The maximum recording area (i.e., the maximum paper width PW), to which the printing operation is applied, is a shorter width of A3 size paper (i.e., the longer width of A4 size paper). The recording part 20 has a process velocity of 240 mm/s, a printing resolution of 800×800 dpi, and a recording speed of 60 sheets per minute (in the case of long edge feed of A4 size paper (A4LEF)).

The function of the ink-jet recording apparatus 10 thus constituted as described in the foregoing will be described.

The printing operation and the maintenance operation (dummy jet, wiping and capping) will be sequentially described.

The printing operation will be firstly described.

Upon carrying out the printing operation, paper is fed from the paper feeding part 12, and after controlling the orientation and the timing of the paper in the registration adjustment part 14, the paper is dispatched to the recording part 20.

In the recording part 20, the motor 106 is driven, and the driving force is transmitted to all the conveying rolls 100 through the flat belt 104.

Accordingly, the paper reaching the recording part 20 is inserted between the conveying roller 100 and the group of star wheels 72A to 72C disposed at the most upstream position. At this time, the star wheel 70 of the group of star wheels 72A to 72C energized with the spring 75 presses the paper onto the conveying roll 100, whereby the conveying force is certainly transmitted from the conveying roll 100 to the paper, and thus the paper is inserted into the lower part of the recording head unit 40 at a constant velocity. Subsequently, the driving force is sequentially transmitted from the conveying rolls 100 between the recording head arrays 42 to convey the paper.

Because all the conveying rolls 100 are driven with the single motor 106, the paper is conveyed at a constant velocity, but it is prevented that accumulated velocity fluctuation of plural driving sources causes fluctuation of the conveying velocity of the paper as in the case where the conveying rolls are driven with plural driving sources. Periodic velocity fluctuation causing an image defect that can be visually recognized on an image is often caused by a problem on processing accuracy of teeth of gears, but because the flat belt 104 is used for transmitting the driving force (without the use of engagement of teeth), such an image defect is prevented from occurring. Furthermore, because the flat belt 104 is wound on the non-printing area of the large diameter part 100B of the conveying roll 100 in contact with the paper, no velocity fluctuation occurs even in the case where the conveying roll 100 causes eccentricity due to the processing accuracy or the retaining system (such as bearings), and thus the paper is conveyed at the moving velocity (constant velocity) of the flat belt 104. In the constitution where the idler roll 114 is disposed to ensure the wound angle of the flat belt 104, periodic velocity fluctuation occurs due to the processing accuracy or the retaining system of the idler roll 114 in the strict sense, but the idler roll 114 can be easily processed with high accuracy at low cost because it has a relatively small size and may be formed with a single material. The conveying roll 100, on the other hand, has a large size and has a constitution containing plural materials including, for example, the core metal and the covering material, and therefore, it is difficult to be processed with high accuracy or becomes a considerably expensive member. The driving system using surface friction with the flat belt 104 has such an effect that even in the case where fluctuation in the radius and the rotational center of the conveying roll 100 occurs, no periodic fluctuation in velocity is caused thereby.

Furthermore, because the group of star wheels 72A to 72C are divided into three parts in the second direction to reduce the length of the shafts 74A to 74C thereof, deflection of the shafts (74A to 74C) can be prevented to press the paper evenly with the plural star wheels 70 energized with the springs 75. Accordingly, the driving force can be evenly transmitted to the paper.

In particular, because the paper is pressed onto the conveying roll 100 with the star wheels 70, the driving force is certainly transmitted to the paper to ensure conveying at a constant velocity. Owing to the nonuse of an electrostatic sorption system, stable conveying can be attained irrespective to the thickness and the material of the paper.

Moreover, because the star wheel 70 is disposed between the recording head units 40, and the guide member 94 is disposed at a position opposite thereto, floatage and the like of the paper can be prevented at the printing position (at the recording head array 42) in the first direction, whereby the planarity of the paper (i.e., a constant distance to the nozzle surface 40A) is ensured.

In other words, the provision of the star wheel 70 ensures the planarity of the paper (i.e., a constant distance to the nozzle surface 40A) even in the case where the maintenance apparatus 81 including the cap member 80 and the like is disposed at the position opposite to the recording head unit 40.

Upon inputting a printing signal to the recording head units 40 of the recording head part 16 from a controlling part of the apparatus, a heating element of the nozzle corresponding to the printing signal generates heat, whereby an ink droplet is discharged to the paper conveyed with a constant distance to the nozzle surface 40A.

Accordingly, printing is carried out with the recording head array 42A, and subsequently, printing is carried out with the recording head array 42B, so as to complete printing in one color on the corresponding part of the paper. Upon conveying the paper in the recording part 20, printing is sequentially carried out with the recording heads 44Y, 44M, 44C and 44K to effect full color printing.

As described in the foregoing, the planarity of the paper (i.e., a constant distance to the nozzle surface 40A) is ensured, and printing is carried out on the paper conveyed at a constant velocity, whereby an image of high image quality can be formed. In particular, because the planarity is stably ensured with the star wheel 70 during conveying in the recording part 20, deformation caused during printing on various kinds of paper having variation in thickness can be favorably corrected, and thus the distance to the nozzle surface 40A can be maintained to a constant value to attain printing with high image quality.

In particular, in the recording part 20, the conveying rolls 100 are disposed between the recording head arrays 42 and also disposed on the upstream of the most upstream recording head array 42YA and on the downstream of the most downstream recording head array 42KB, and the plural conveying rolls 100 are driven with the single driving source. Consequently, the paper is certainly conveyed at a constant velocity to attain printing with high image quality.

The operation of dummy jet will be then described.

The dummy jet is carried out upon non-printing or after every times of completion of printing of a prescribed number of sheets during continuous printing of plural sheets of paper but before reaching an edge of subsequent paper. That is, discharging of an ink droplet is carried out from an arbitrary nozzle among all the recording head units 40 constituting the recording heads 44Y to 44K to the cap member 80 (i.e., so-called dummy jet). The dummy jet may be carried out for all the nozzles of all the recording head units 40, for all the nozzles 58 of the selected recording head unit 40 or the selected recording head array 42, or only for such a nozzle 58 that has not ejected an ink droplet for a prescribed period of time.

For example, the distance between the nozzle surface 40A and the upper surface of the cap member 80 upon carrying out the dummy jet during continuous printing of plural sheets of paper is set at 3 mm, and 500 droplets are ejected from all the nozzles, respectively, at the time between passage of preceding recording paper and arrival of subsequent recording paper by 30 sheets of A4 size paper.

At this time, the provision of the ink absorbent 86 at the bottom of the concave part 82A of the cap member 80 prevents the thus-ejected ink from suffering flood and splash from the concave part 82A.

For example, the change in discharging performance due to drying of an ink (particularly, an aqueous ink and a solvent ink) can be initialized by ejecting ink droplets (dummy jet) from all the nozzles of the recording head unit 40. Even in the case of an oily ink and a solid ink, which are substantially not dried, the dummy jet can remove bubbles attached to the ink flow path inside the head and dusts attached on the nozzle surface upon printing, whereby the discharging performance of ink droplets of the nozzles can be initialized.

The printing speed (productivity) is improved in the first embodiment because the dummy jet can be carried out during continuous printing of plural sheets of paper thus conveyed without movement of the recording head 44 and the cap member 80. Furthermore, the printing performance of the recording head 44 can be constantly maintained by the dummy jet to enable printing with high image quality.

The wiping operation will be described.

The wiping operation is carried out before starting printing. The recording head unit 40 (nozzle surface 40A) is wiped with the wiping member 88 of the maintenance part 18. The specific operation will be described based on the schematic figures shown in FIGS. 11A to 11G.

The driving motor 304 of the elevating mechanism 302 shown in FIG. 10 is firstly driven to bring down the common substrate 300 by rotation of the eccentric cam 306. The driving motor 318 of the moving mechanism 312 is driven to raise the slider 314 and the common substrate 310 supported by the slider 314. Accordingly, the six cap members 80 attached to the common substrate 300 descend from the home position (i.e., moving in a direction of leaving from the recording head 40), and the six wiping member 88 attached to the common substrate 310 rise from the home position (i.e., moving in the direction of approaching the nozzle surface 40A of the recording head unit 40), as shown in FIGS. 11A and 11B.

In this embodiment, the cap member 80 descends to the position at 6 mm from the nozzle surface 40A of the recording head unit 40, and the tip end (upper end) of the wiper 92 of the wiping member 88 rises to the position higher than the nozzle surface 40A by 1.5 mm (hereinafter, referred to as a contact amount of 1.5 mm).

As a result, the retaining member 90 of the wiping member 88 becomes movable by overstriding the cap member 80. The wiper 92 of the wiping member 88 is in such a state that it overlaps the nozzle surface 40A of the recording head unit 40 in the direction (the direction shown by the arrow Z in FIGS. 11A to 11G) as shown in FIG. 11B.

In this state, the driving motor 316 of the moving mechanism 312 shown in FIG. 10 is driven to move the common substrate 310 in the second direction on the slider 314 through the rack 322 engaged with the driving gear 326. Accordingly, the wiping member 88 attached to the common substrate 310 is moved in the second direction, whereby the wiper 92 of the wiping member 88, the tip end of which is at a position higher than the nozzle surface 40A, is moved with slidingly contacting with the nozzle surface 40A of the recording head unit 40. As a result, dusts and a dried ink attached to the nozzle surface 40A are removed as shown in FIG. 11C. At this time, the wiping member 88 is moved by overstriding the cap member 80 thus having descended.

In this embodiment, the wiper 92 is in slidingly contact with the nozzle surface 40A with maintaining the contact amount of 1.5 mm, whereby contamination attached to the nozzle surface 40A is certainly removed.

Figure 11D:
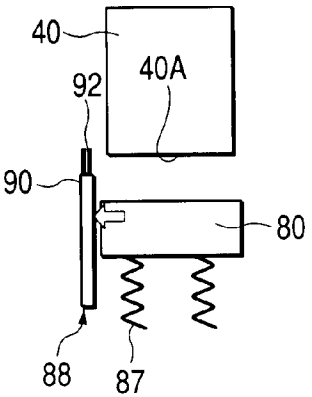
Figure 11E:
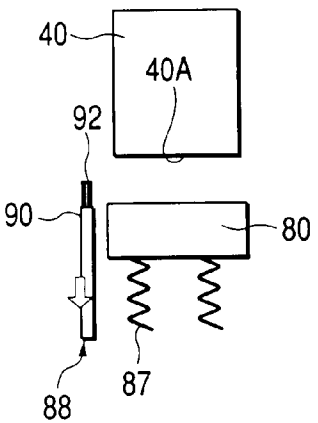

The wiping member 88 then escapes from the area under the nozzle surface 40A to complete the movement of the wiping member 88 and the guide member 94 in the second direction as shown in FIG. 11D. Subsequently, the common substrate 310, i.e., the wiping member 88, is brought down by driving the driving motor 318 of the moving mechanism 312 to move to the height of the home position as shown in FIG. 11E.

Figure 11F:
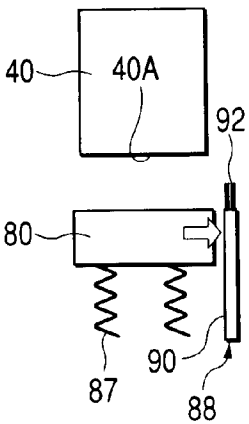
Figure 11G:
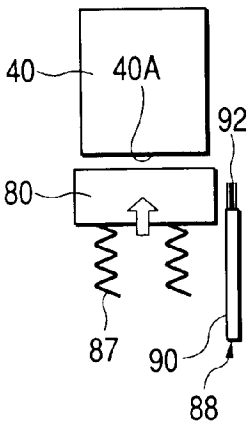
Figure 11G:
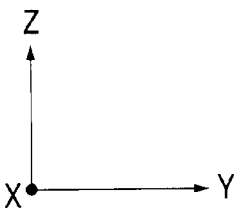

The common substrate 310, i.e., the wiping member 88, is then moved to the opposite side in the second direction by driving the driving motor 318 of the moving mechanism 312 to make it revert to the home position as shown in FIG. 11F. Furthermore, the cap member 80 is raised by driving the driving motor 304 of the elevating mechanism 302 to make it revert to the home position near the nozzle surface 40A of the recording head 40, whereby the wiping operation is completed as shown in FIG. 11G.

Subsequently, the capping operation will be described.

Figure 14A:
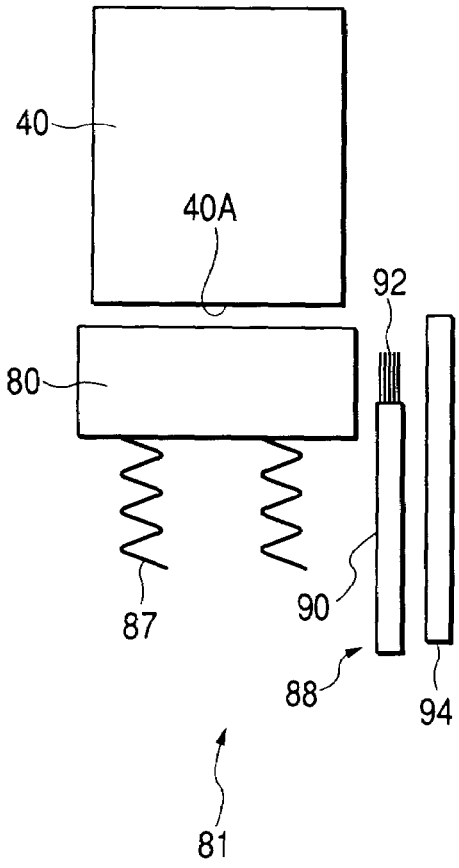
FIGS. 14A and 14B are operational explanatory views showing capping operation in a recording apparatus according to an embodiment of the invention.
Figure 14B:
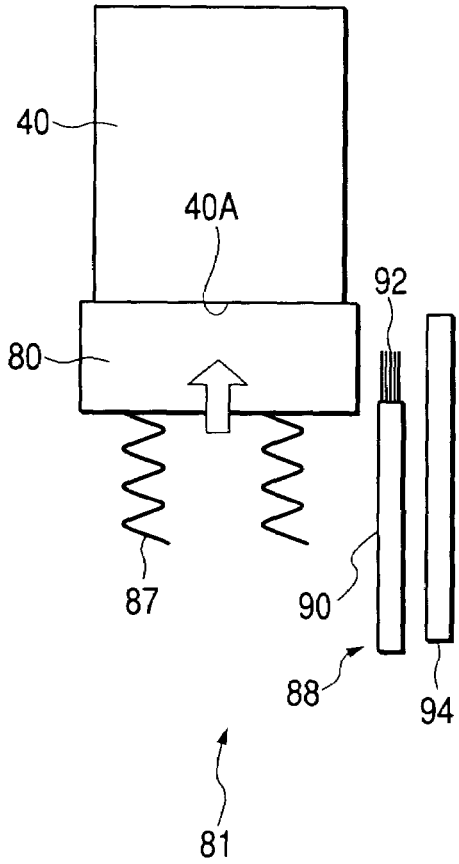

The capping operation is carried out in the case where the non-printing state continues for a long period of time, or in the case where the power of the apparatus is turned off. Specifically, the driving motor 304 of the elevating mechanism 302 shown in FIG. 10 is driven to raise the common substrate 300 to press the rubber member 84 of the cap member 80 attached to the common substrate 300 onto the nozzle surface 40A of the recording head 40 as shown in FIGS. 14A and 14B. As a result, the airtightness of the nozzle surface 40 (i.e., the nozzles 58) is ensured, whereby increased viscosity and drying of the ink are prevented, and attachment of dusts is also prevented.

As shown in FIG. 4, the recording head 44 in this embodiment is constituted by attaching the recording head arrays 42A and 42B formed by arranging plural short recording head units 40 to the common substrates 46A and 46B, respectively, whereby the production thereof can be standardized as with inexpensive apparatuss (recording heads), which are mass-produced, and the recording head 40 capable of printing on the entire width can be produced at low cost.

Furthermore, the recording head arrays 42A and 42B are attached to the common substrates 46A and 46B, respectively, whereby the constitutions of the recording head arrays 42A and 42B are simplified, and thus the production and the adjustment in high accuracy thereof can be conveniently carried out. Furthermore, there is such an advantage that the constitution of the maintenance part (including the cap member 80 and the wiping member 88) can be standardized as with those used in a recording head of a short length. Moreover, there is also such an advantage that a unit for making constant the distance between the nozzle surface 40A and the paper (e.g., the star wheel 70 in this embodiment) can be disposed by utilizing the gap (space) among the recording head units in the second direction, or the degree of freedom in designing the arrangement of the cap member 80 can be increased by that gap (space).

While one cap member 80 is provided as corresponding to one recording head unit 40 in this embodiment, only one cap member 80 may be provided as corresponding to plural recording head units 40.

The apparatus for correcting ink droplets placement errors according to this embodiment will be described. The apparatus for correcting ink droplets placement errors is equipped in the aforementioned recording apparatus.

Figure 15:
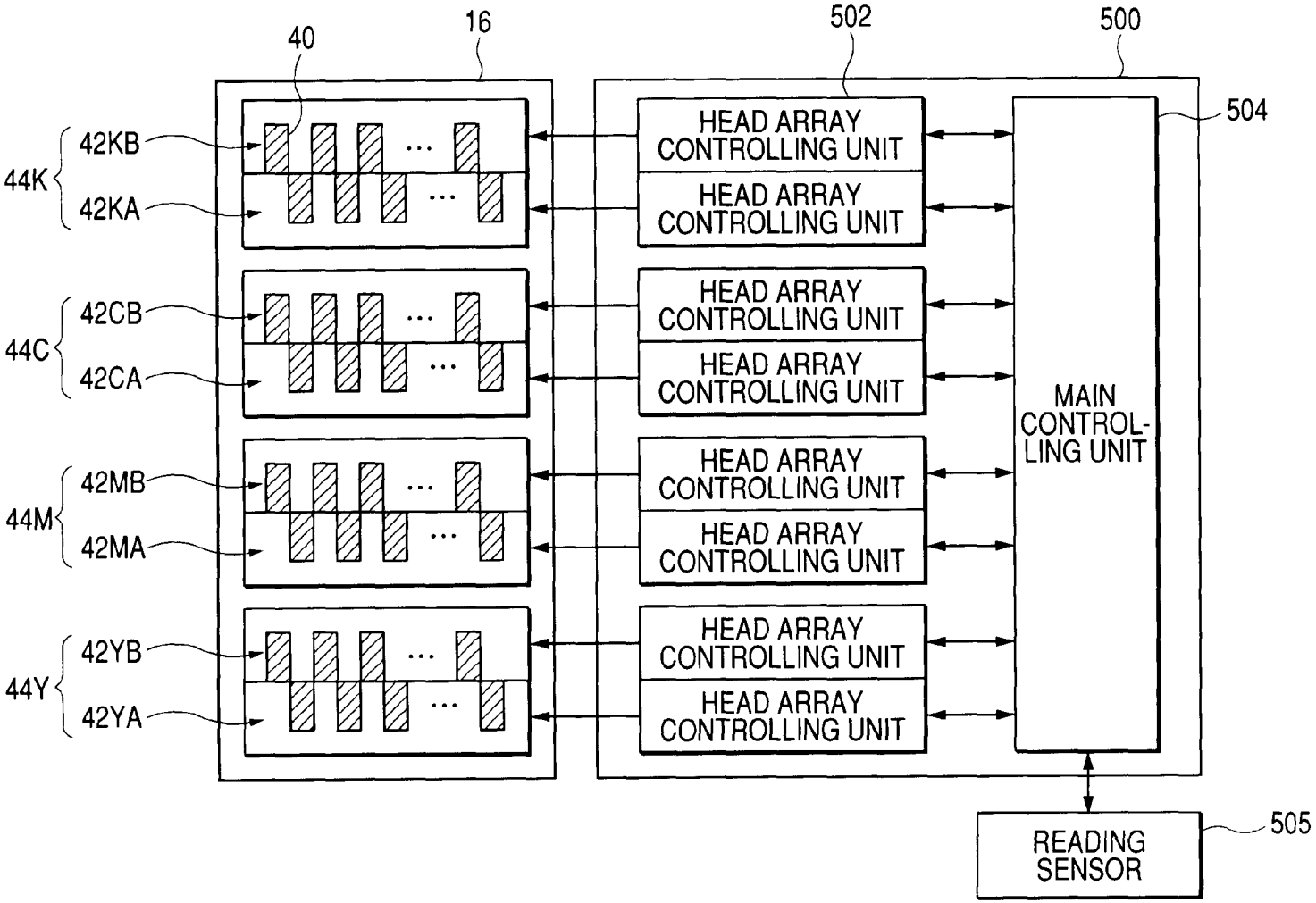
FIG. 15 is a block diagram showing an apparatus for correcting ink droplets placement errors.

As shown in FIG. 15, an apparatus for correcting ink droplets placement errors 500 has head array controlling units 502 provided for the every for recording head arrays 42KB to 42YA of the recording heads 44K to 44Y provided for the respective colors. The head array controlling units 502 compensate the ink droplets placement errors in the subsidiary scanning direction (i.e., the first direction) of the recording head arrays 42KB to 42YA. The apparatus for correcting ink droplets placement errors 500 also has a main controlling unit 504 connected to the respective head array controlling units 502. The main controlling unit 504 is connected to a reading sensor 505 as a reading unit for reading an image or the like recorded on the paper, which is disposed on the path, over which the paper is conveyed from the recording part 16 and then housed in the tray 32.

Figure 16:
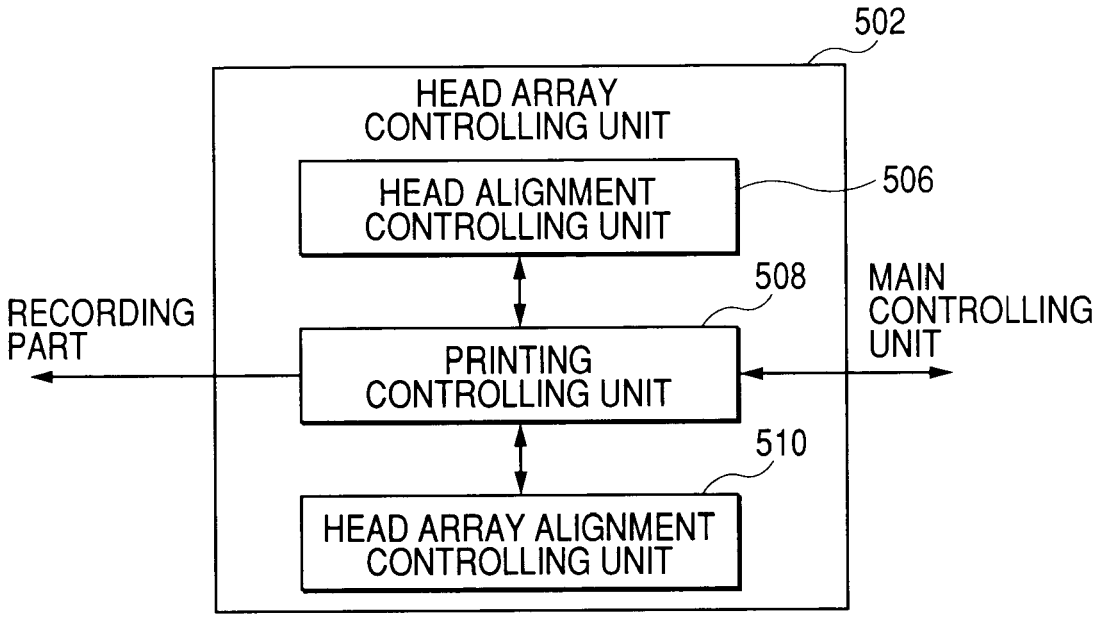
FIG. 16 is a block diagram showing a head array controlling unit.

Since all the head array controlling units 502 have the same constitution, only one of the head array controlling units 502 will be described below, and descriptions for the others are omitted herein. As shown in FIG. 16, the head array controlling unit 502 has a recording head controlling board, as a first controlling board, having thereon a printing controlling unit 508, as a first controlling unit, for controlling the recording head units 40 in the recording head array to eject an ink, a head alignment controlling unit 506, as a first detecting unit connected to the printing controlling unit 508, for detecting displacement in the subsidiary scanning direction of the plural recording head units 40 in the recording head array, and a head array alignment controlling unit 510, as a second detecting unit connected to the printing controlling unit 508, for detecting displacement in the subsidiary scanning direction of the plural recording head arrays (two recording head arrays in this embodiment) for one color.

Figure 17:
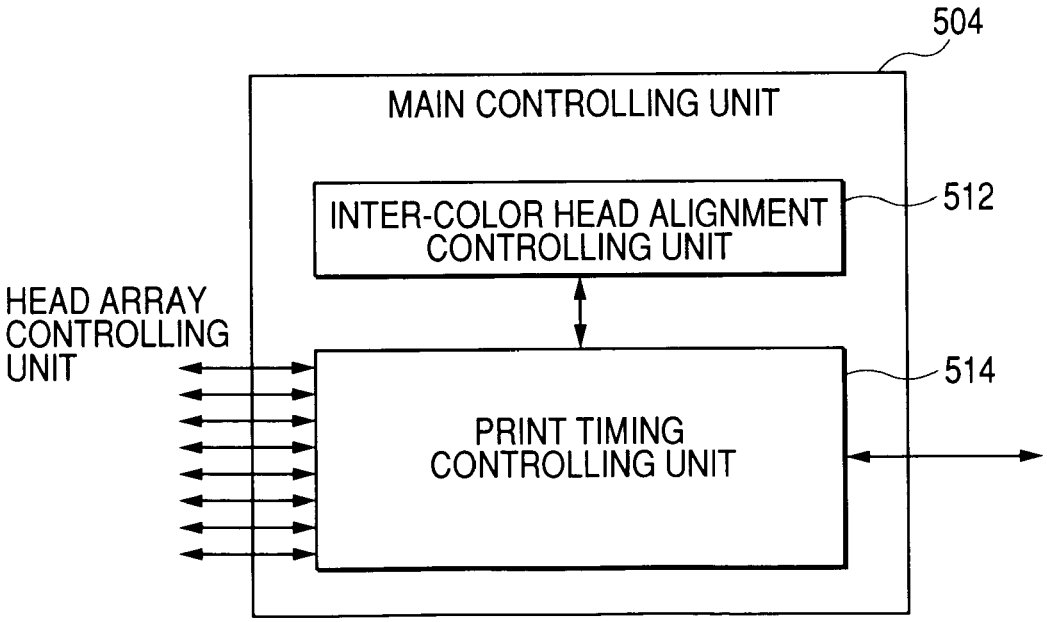
FIG. 17 is a block diagram showing a main controlling unit.

As shown in FIG. 17, the main controlling unit 504 has a main controlling board as a second controlling board having thereon an inter-color head alignment controlling unit 512, as a third detecting unit, for detecting displacement in the subsidiary scanning direction of the plural recording heads (four recording heads in this embodiment), and a printing timing controlling unit 514, as a second controlling unit connected to and controlling the respective printing controlling units 508, for controlling the ink discharging timing of an ink ejected from the plural recording head units 40 in the recording head array.

As described in the foregoing, the head alignment controlling unit 506 corresponds to the first detecting unit of the invention, the head array alignment controlling unit 510 corresponds to the second detecting unit, and the inter-color head array alignment controlling unit 512 corresponds to the third detecting unit. Furthermore, as described in the foregoing, the printing controlling unit 508 corresponding to the first controlling unit of the invention, and the printing timing controlling unit 514 corresponds to the second controlling unit.

The printing timing controlling unit 514 outputs, to the respective printing controlling units 508, printing pulses having a prescribed period expressing timing for ejecting an ink from the recording head units in the respective recording head arrays.

The controlling units 506, 508, 510, 512 and 514 each are constituted with an IC chip and the like. The printing controlling unit 508 has an oscillator thereinside for oscillating controlling pulses. The controlling pulse has a shorter period than the printing pulse.

The head array alignment controlling unit 510 may be provided on the main controlling board.

Figure 18:
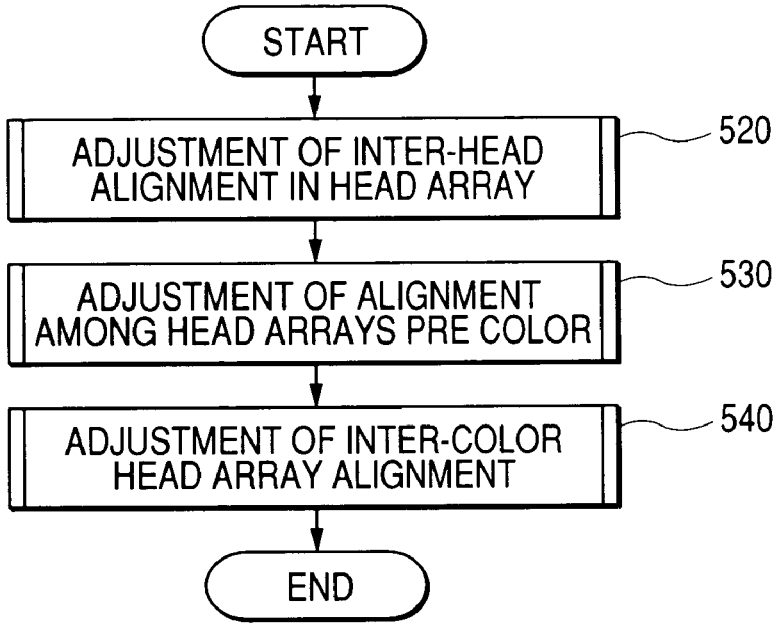
FIG. 18 is a flow chart showing a control routine for correcting ink droplets placement errors.

The function of the apparatus for correcting ink droplets placement errors 500 will be described with reference to FIG. 18 by following the flow chart showing the control routine for correcting ink droplets placement errors.

The routine starts when a switch for correcting ink droplets placement errors, which is not shown in the figure, is turned on, in which the inter-head alignment in the head array is adjusted in the step 520, the alignment among head arrays per color is adjusted in the step 530, and the inter-color head array alignment is adjusted in the step 540.

The steps will be described in more detail.

Figure 19:
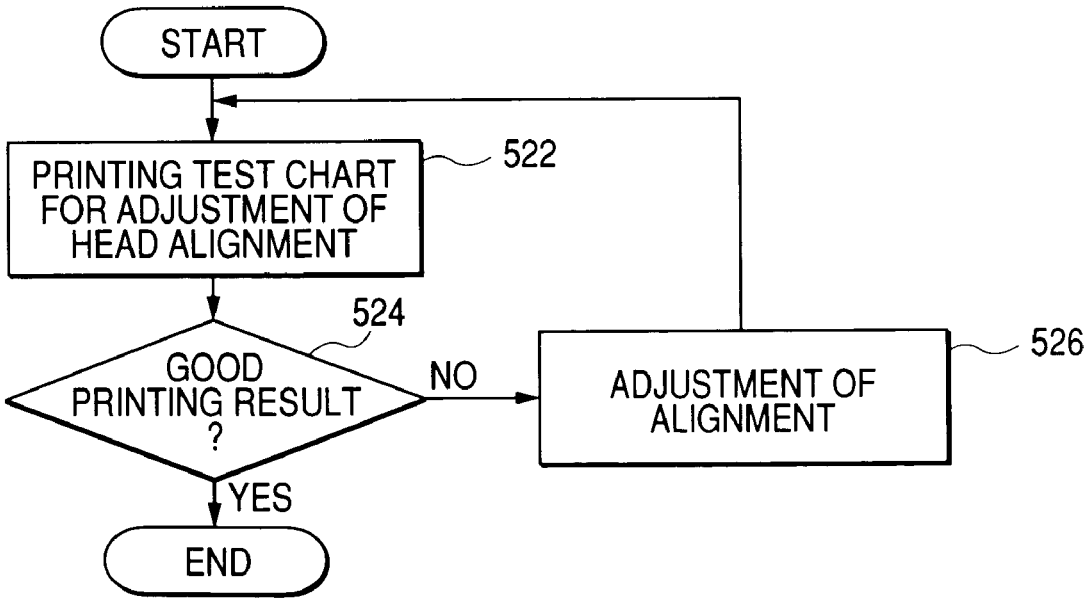
FIG. 19 is a flow chart showing a subroutine of the step 520 of the control routine for correcting ink droplets placement errors.

As shown in FIG. 19, in the step 520 for adjusting the inter-head alignment in the head array, the recording head units of the respective recording head arrays in the respective recording heads are controlled to print a test chart for adjusting head alignment as an image for adjusting the ink discharging timing for detecting the ink droplets placement errors in the subsidiary scanning direction of the recording head units of the respective recording head arrays, in the step 522. The error by the recording head units is a first ink droplets placement error.

In the step 524, the test chart for adjusting head alignment is read by the reading sensor 505, and the ink droplets placement errors on recording in the subsidiary scanning direction of the recording head units of the recording head array are identified by the head alignment controlling unit 506 based on the result thus read. It is then determined as to whether or not the ink droplets placement errors thus identified are in a prescribed tolerance level, so as to judge as to whether or not compensation is necessary, i.e., whether or not the printing result is good.

In the case where it is judged that the printing result is good, the printing controlling unit 508 completes the subroutine, and in the case where it is judged that the printing result is not good, it carries out, in the step 526, adjustment of alignment in the subsidiary scanning direction of the recording head units of the recording head array based on the ink droplets placement errors thus identified.

In the alignment adjustment in the step 526, rough adjustment is carried out based on the printing pulses, and fine adjustment is carried out based on the controlling pulses. That is, in the rough adjustment, the ink discharging timing of the recording head unit is adjusted (controlled) per the period of the printing pulses. In the fine adjustment, the ink discharging timing of the recording head unit is adjusted (controlled) per the period of the controlling pulses.

After completing the step 526, the subroutine is returned to the step 522, and then the steps 522 and 524 are again carried out.

According to the foregoing, for example, the ink droplets placement errors on recording in the subsidiary scanning direction of the recording head units 40 of the recording head array 42KB of the recording head 44K is made in the tolerance level by the adjustment (control) of the ink discharging timing of the recording head units. The same procedures are also applied to the other recording head array 42KA and the other recording heads 44C, 44M and 44Y.

Figure 20:
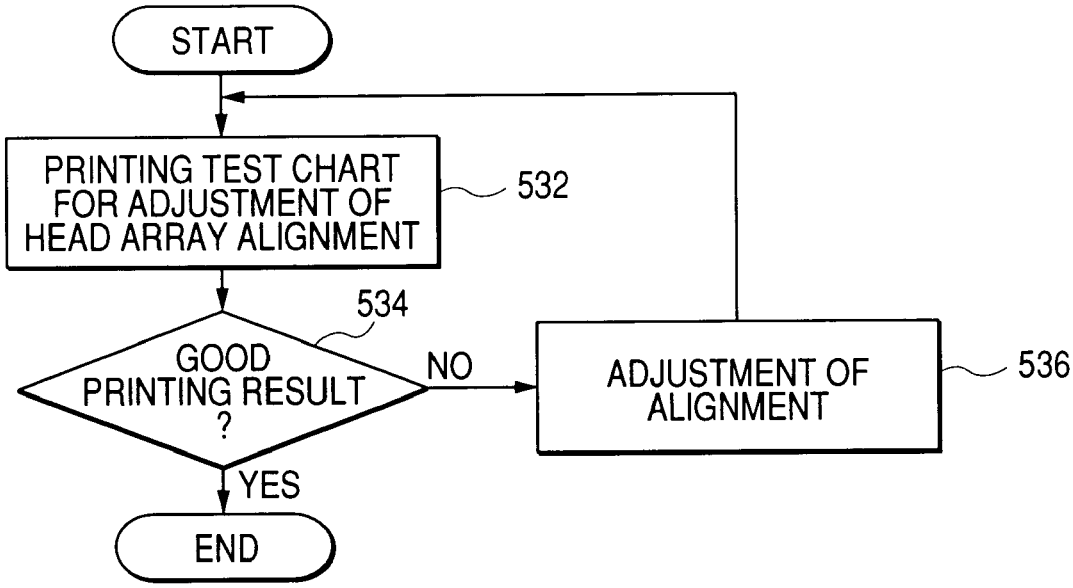
FIG. 20 is a flow chart showing a subroutine of the step 530 of the control routine for correcting ink droplets placement errors.

As shown in FIG. 20, in the step 530 for adjusting alignment among the head arrays per color, the recording head units of the respective recording head arrays in the respective recording heads are controlled to print a test chart for adjusting head array alignment as an image for adjusting the ink discharging timing for detecting the ink droplets placement errors in the subsidiary scanning direction of the recording head arrays per color, in the step 532. The error by the recording head arrays is a second ink droplets placement error.

In the step 534, the test chart for adjusting head array alignment is read by the reading sensor 505, and the ink droplets placement errors on recording in the subsidiary scanning direction of the recording head arrays are identified by the head array alignment controlling unit 510 based on the result thus read. It is then determined as to whether or not the ink droplets placement errors thus identified are in a prescribed tolerance level, so as to judge as to whether or not compensation is necessary, i.e., whether or not the printing result is good.

In the case where it is judged that the printing result is good, the printing controlling unit 508 completes the subroutine, and in the case where it is judged that the printing result is not good, it carries out, in the step 536, adjustment of alignment in the subsidiary scanning direction of the recording head arrays based on the ink droplets placement errors thus identified.

In the alignment adjustment in the step 536, rough adjustment is carried out based on the printing pulses, and fine adjustment is carried out based on the controlling pulses. That is, in the rough adjustment, the ink discharging timing of the recording head unit is adjusted (controlled) per the period of the printing pulses. In the fine adjustment, the ink discharging timing of the recording head unit is adjusted (controlled) per the period of the controlling pulses.

After completing the step 536, the subroutine is returned to the step 532, and then the steps 532 and 534 are again carried out.

According to the foregoing, for example, the ink droplets placement errors on recording in the subsidiary scanning direction between the recording head units 40 of the recording head array 42KA of the recording head 44K and the recording head units 40 of the recording head array 42KB of the recording head 44K is made in the tolerance level by the adjustment (control) of the ink discharging timing of the recording head units. The same procedures are also applied to the other recording heads 44C, 44M and 44Y.

Figure 21:
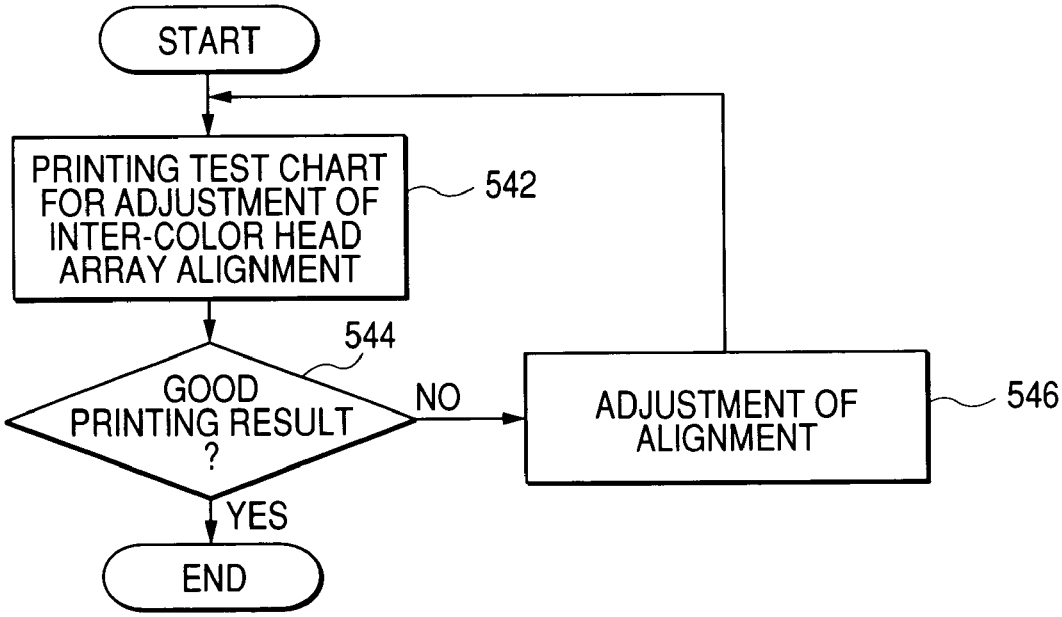
FIG. 21 is a flow chart showing a subroutine of the step 540 of the control routine for correcting ink droplets placement errors.

As shown in FIG. 21, in the step 540 for adjusting inter-color head array alignment, the recording head unit of the respective recording head arrays in the respective recording heads are controlled to print a test chart for adjusting inter-color head array alignment as an image for adjusting the ink discharging timing for detecting the ink droplets placement errors in the subsidiary scanning direction of the respective recording heads, in the step 542. The error by the recording heads is a third ink droplets placement error.

In the step 544, the test chart for adjusting inter-color head array alignment is read by the reading sensor 505, and the ink droplets placement errors on recording in the subsidiary scanning direction of the recording heads are identified by the inter-color head array alignment controlling unit 512 based on the result thus read. It is then determined as to whether or not the ink droplets placement errors thus identified are in a prescribed tolerance level, so as to judge as to whether or not compensation is necessary, i.e., whether or not the printing result is good.

In the case where it is judged that the printing result is good, the printing timing controlling unit 514 completes the subroutine, and in the case where it is judged that the printing result is not good, it carries out, in the step 546, adjustment of alignment in the subsidiary scanning direction of the recording head arrays based on the ink droplets placement errors thus identified.

In the alignment adjustment in the step 546, rough adjustment is carried out based on the printing pulses, and fine adjustment is carried out based on the controlling pulses. That is, in the rough adjustment, the ink discharging timing of the recording head unit is adjusted (controlled) per the period of the printing pulses. In the fine adjustment, the ink discharging timing of the recording head unit is adjusted (controlled) per the period of the controlling pulses.

After completing the step 546, the subroutine is returned to the step 542, and then the steps 542 and 544 are again carried out.

According to the foregoing, the ink droplets placement errors on recording in the subsidiary scanning direction of the recording head units 40 of the recording head arrays in the recording heads 44K, 44C, 44M and 44Y is made in the tolerance level by the adjustment (control) of the ink discharging timing of the recording head units.

In this embodiment as described in the foregoing, the ink droplets placement errors of the ink-jet recording apparatus is reduced by controlling the ink discharging timing of the recording head units, whereby the ink droplets placement errors of the ink-jet recording apparatus can be corrected with high accuracy.

While the recording heads in the embodiment as described in the foregoing each is constituted with two head arrays, the recording head each may be constituted with one recording head array. In this case, the head array alignment controlling unit 510 and the step 530 (i.e., the steps 532 to 536) can be omitted.

In this embodiment as described in the foregoing, the prescribed test charts are formed and read to determine the ink droplets placement errors for each of the adjustment of the inter-head alignment in the head array, the adjustment of the alignment among the head arrays per color, and the adjustment of the inter-color head array alignment, respectively. However, the invention is not limited to this embodiment, and it is possible that only one test chart is formed and read to determine the ink droplets placement errors for the adjustment of the inter-head alignment in the head array, the adjustment of the alignment among the head arrays per color, and the adjustment of the inter-color head array alignment, whereby the adjustment of the inter-head alignment in the head array, the adjustment of the alignment among the head arrays per color, and the adjustment of the inter-color head array alignment are simultaneously carried out.

Furthermore, in this embodiment as described in the foregoing, the prescribed test charts are formed and read to determine the ink droplets placement errors. However, the invention is not limited to this embodiment, and it is possible that the ink droplets placement errors are input with an input by a user, and the adjustment of the inter-head alignment in the head array, the adjustment of the alignment among the head arrays per color, and the adjustment of the inter-color head array alignment are carried out based on the ink droplets placement errors thus input.

As described in the foregoing, the invention has such an effect that the ink droplets placement errors on recording is reduced by controlling the ink discharging timing of the recording head units, and accordingly, ink droplets placement errors of a recording apparatus can be corrected with high accuracy.

The entire disclosure of Japanese Patent Application No. 2003-063570 filed on Mar. 10, 2003 including specification, claims, drawings and abstract is incorporated herein by reference in its entirety.

What is claimed is:

1. A system for correcting ink droplet placement errors in a recording apparatus, comprising:

a recording apparatus recording images on a recording medium which is conveyed in a first direction past discharging ink droplets from a recording head part to the recording medium, the recording head part having a plurality of recording heads arranged in the first direction, the recording heads having a plurality of recording head arrays, the recording head arrays having a plurality of recording head units arranged in a second direction perpendicular to the first direction, the recording head units having an ink discharging surface;

an identifying unit for identifying ink droplet placement errors by the recording head units in the first direction; and a controlling unit for controlling timing to discharge ink droplets by the recording head units to reduce ink droplet placement errors based on the errors;

wherein the controlling unit controls timing to discharge ink droplets roughly based on a printing pulse and controls timing to discharge the droplets finely based on a controlling pulse having a higher frequency than that of the printing pulse.

2. The system according to claim 1, wherein the identifying unit includes a reading unit for reading images on a recording medium, the images being printed by the recording head part; a detecting unit for detecting the ink droplet placement errors in the first direction by each of the recording head units based on the reading images provided by the reading unit, and the controlling unit controls the timing based on the errors provided by the detecting unit.

3. The system according to claim 2, wherein the recording head units are disposed in a staggered arrangement, the detecting unit further detects ink droplet placement errors of the recording head arrays, and the controlling unit further controls timing to discharge ink droplets from the recording head units based on the errors provided by the detecting unit.

4. The system according to claim 3, wherein the detecting unit further detects ink droplet placement errors of the recording heads in the first direction, and the controlling unit further controls timing to discharge ink droplets from the recording head units of each of the recording heads to reduce the errors based on the errors provided by the detecting unit.

5. A system for correcting ink droplet placement errors in a recording apparatus, comprising:

a recording apparatus recording images on a recording medium which is conveyed in a first direction past discharging ink droplets from a recording head part to the recording medium, the recording head part having a plurality of recording heads in the first direction, the recording heads having a plurality of recording head arrays, the recording head arrays having a plurality of recording head units in a second direction perpendicular to the first direction, the recording head units having an ink discharging surface;

an identifying unit for identifying ink droplet placement errors by the recording head arrays in the first direction; and a controlling unit for controlling timing to discharge ink droplets by the recording head units to reduce the errors based on the errors;

wherein the controlling unit controls timing to discharge ink droplets roughly based on a printing pulse and controls timing to discharge the droplets finely based on a controlling pulse having a higher frequency than that of the printing pulse.

6. The system according to claim 5, wherein the identifying unit includes a reading unit for reading images on a recording medium, the images being printed by the recording head part; a detecting unit for detecting the ink droplet placement errors in the first direction provided by each of the recording heads based on the reading images provided by the reading unit, and the controlling unit controls the timing based on the errors provided by the detecting unit.

7. The system according to claim 6, wherein the recording head units are disposed in a staggered arrangement, the detecting unit further detects ink droplet placement errors provided by the recording heads in the first direction, and the controlling unit further controls timing to discharge ink droplets from the recording head units of the recording head arrays to reduce the errors based on the errors by the detecting unit.

8. A system for correcting ink droplet placement errors in a recording apparatus, comprising:

a recording apparatus recording images on a recording medium which is conveyed in a first direction past discharging ink droplets from a recording head part to the recording medium, the recording head part having a plurality of recording heads, the recording heads having a plurality of recording head arrays in the first direction, the recording head arrays having a plurality of recording head units in a second direction perpendicular to the first direction, the recording head units being disposed in a staggered arrangement, the recording head units having an ink discharging surface, an identifying unit for identifying ink droplet errors by the recording heads in the first direction; and a controlling unit for controlling timing to discharge ink droplets by the recording head units to reduce ink droplet placement errors based on the errors;

wherein the controlling unit controls timing to discharge ink droplets roughly based on a printing pulse and controls timing to discharge the droplets finely based on a controlling pulse having a higher frequency than that of the printing pulse.

9. The system according to claim 8, wherein the identifying unit includes a reading unit for reading images on a recording medium, the images being printed by the recording head part; a detecting unit for detecting the ink droplet placement errors in the first direction by the recording head arrays based on reading images provided by the reading unit, and the controlling unit controls timing based on the errors provided by the detecting unit.

10. An apparatus for correcting ink droplet placement errors in a recording apparatus, the recording apparatus recording images on a recording medium which is conveyed in a first direction past discharging ink droplets from a recording head part to the recording medium, the recording head part having a plurality of recording heads, the recording heads having a plurality of recording head arrays in the first direction, the recording head arrays having a plurality of recording head units in a second direction perpendicular to the first direction, the recording head units being disposed in a staggered arrangement, the recording head units having an ink discharging surface, the apparatus for correcting ink droplet placement errors comprising:

an identifying unit for identifying ink droplet errors by the recording heads in the first direction, the identifying unit including a reading unit for reading images on a recording medium, the images being printed by the recording head part, and a detecting unit for detecting the ink droplet placement errors in the first direction by the recording head arrays based on reading images provided by the reading unit; and a controlling unit for controlling timing to discharge ink droplets by the recording head units to reduce ink droplet placement errors based on the errors, wherein the controlling unit controls timing based on the errors provided by the detecting unit to discharge ink droplets roughly based on a printing pulse and controls timing to discharge the droplets finely based on a controlling pulse, wherein the controlling pulse has a higher frequency than that of the printing pulse.

11. The apparatus according to claim 10, wherein the printing pulse controls the timing to record on the medium for every line in the first direction.

12. A system for correcting ink droplet placement errors in a recording apparatus, comprising:

a recording apparatus for recording images on a recording medium which is conveyed in a first direction past discharging ink droplets from a recording head part to the recording medium, the recording head part having a plurality of recording heads, the recording heads having a plurality of recording head arrays in the first direction, the recording head arrays having a plurality of recording head units in a second direction perpendicular to the first direction, the recording head units being disposed in a staggered arrangement, the recording head units having a ink discharging surface, an identifying unit for identifying ink droplet placement errors by the recording head units, the recording head arrays, and recording heads in the first direction; and a controlling unit for controlling timing to discharge ink droplets by the recording head units to reduce ink droplet placement errors in the first direction based on a first ink droplet placement error provided by the recording head units, a second ink droplet placement error provided by the recording head arrays, and a third ink droplet placement error provided by the recording heads;

wherein the controlling unit controls timing to discharge ink droplets roughly based on a printing pulse and controls timing to discharge the droplets finely based on a controlling pulse having a higher frequency than that of the printing pulse.

13. The system according to claim 12, wherein the identifying unit includes a first controller unit for controlling the recording head units to discharge ink droplets from the surface of the recording head units, and a second controller unit for controlling the timing to discharge ink droplets from the surface of the recording head units by controlling the first controller unit, the controller units being provided with each recording head array.

14. An apparatus for correcting ink droplet placement errors in a recording apparatus, the recording apparatus for recording images on a recording medium which is conveyed in a first direction past discharging ink droplets from a recording head part to the recording medium, the recording head part having a plurality of recording heads, the recording heads having a plurality of recording head arrays in the first direction, the recording head arrays having a plurality of recording head units in a second direction perpendicular to the first direction, the recording head units being disposed in a staggered arrangement, the recording head units having a ink discharging surface, comprising:

an identifying unit for identifying ink droplet placement errors by the recording head units, the recording head arrays, and recording heads in the first direction;

a controlling unit for controlling timing to discharge ink droplets by the recording head units to reduce ink droplet placement errors in the first direction based on a first ink droplet placement error provided by the recording head units, a second ink droplet placement error provided by the recording head arrays, and a third ink droplet placement error provided by the recording heads;

wherein the identifying unit includes a reading unit for reading images on the recording medium, the images being printed by the recording head part, a detecting unit for detecting the ink droplet placement errors in the first direction, the detecting unit having a first detecting unit for detecting the errors by the recording head units and a second detecting unit for detecting the errors by the recording head arrays and a third detecting unit for detecting the errors by the recording heads, based on the reading images provided by the reading unit, wherein the controlling unit controls timing based on the errors provided by the first or second or third detecting unit.

15. The apparatus according to claim 14, further comprising:

a first controlling board having the first detecting unit and the second detecting unit; and a second controlling board having the third detecting unit and the controlling unit.

16. The apparatus according to claim 14, wherein the controlling unit includes a first controller unit for controlling the recording head units to discharge ink droplets from the surface of the recording head units, and a second controller unit for controlling the timing to discharge ink droplets from the surface of the recording head units by controlling the first controller unit, and the apparatus further comprising a first controlling board having the first controller unit and the first detecting unit and the second detecting unit, and the second controlling board having the third detecting unit and the second controller unit.

17. A recording apparatus for recording images on a recording medium which is conveyed in a first direction past discharging ink droplets comprising:

a recording head part having a plurality of recording heads in a first direction, a plurality of recording head arrays having a plurality of recording head units in a second direction perpendicular to the first direction, the recording head arrays being held by the recording head, the recording head units having an ink discharging surface and being disposed in a staggered arrangement;

an identifying unit for identifying a first and second and third error, corresponding respectively to the recording head units and head arrays and heads in the first direction; and a controlling unit for controlling timing to discharge ink droplets by the recording head units to reduce ink droplet placement errors in the first direction based on the first error provided by the identifying unit corresponding to the recording head units, the second error provided by the identifying unit corresponding to the recording head arrays, and the third error provided by the identifying unit corresponding to the recording heads;

wherein the controlling unit controls timing to discharge ink droplets roughly based on a printing pulse and controls timing to discharge the droplets finely based on a controlling pulse having a higher frequency than that of the printing pulse.

18. A correcting method for correcting ink droplet placement errors comprising the steps of:

detecting for a first ink placement error between recording head units arranged in a direction perpendicular to a recording medium conveying direction;

detecting for a second ink placement error between recording head arrays arranged in the recording medium conveying direction and respectively having a plurality of recording head units arranged in the direction perpendicular to the recording medium conveying direction; and controlling timing to discharge the droplets from the recording head units to reduce the first ink placement error and the second ink placement error based on the detected first ink placement error and the detected second ink placement error;

wherein the timing of ink droplet discharge is controlled roughly by a printing pulse and finely by a controlling pulse having a higher frequency than that of the printing pulse.

19. A system for correcting ink droplet placement errors in a recording apparatus, comprising:

a recording apparatus recording images on a recording medium which is conveyed in a first direction past discharging ink droplets from a recording head part to the recording medium, the recording head part having a plurality of recording head units having an ink discharging surface;

an identifying unit for identifying ink droplet placement errors by the recording head units in the first direction; and a controlling unit for controlling timing to discharge ink droplets by the recording head units to reduce ink droplet placement errors based on the errors, the controlling unit controls timing to discharge ink droplets roughly based on a printing pulse and controls timing to discharge the droplets finely based on a controlling pulse, wherein the controlling pulse has a higher frequency than that of the printing pulse.

* * * * *